US006131224A

United States Patent [19]

Bernal

[11] Patent Number: 6,131,224

[45] **Date of Patent: *Oct. 17, 2000**

[54] COUPLING DEVICE FOR TRANSFER BETWEEN A STATIC STRUCTURE AND A DYNAMIC STRUCTURE

[75] Inventor: Alvaro Bernal, Santafe de Bogota, Colombia

[73] Assignee: Texaco Inc., White Plains, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/061,616

[22] Filed: Apr. 16, 1998

[51] Int. Cl.[7] ..... B63B 27/14; E01D 15/24

[52] U.S. Cl. ..... 14/69.5; 14/71.1; 14/71.3; 14/72.5

[58] Field of Search ..... 14/29, 31, 32, 14/33, 34, 35, 42, 43, 69.5, 71.1, 71.3, 71.5, 72.5

[56] References Cited

U.S. PATENT DOCUMENTS

| | | | |
|---|---|---|---|
| 2,641,785 | 6/1953 | Pitts et al. | 14/71.1 |
| 3,239,286 | 3/1966 | Harrison . | |
| 3,817,550 | 6/1974 | Young | 280/680 |
| 4,003,473 | 1/1977 | Ryan | 14/71.7 |
| 4,083,072 | 4/1978 | Ryan | 14/69.5 |
| 4,133,283 | 1/1979 | Ryan | 114/230 |
| 4,162,551 | 7/1979 | Serrano | 14/69.5 |
| 4,169,296 | 10/1979 | Wipkink et al. | 14/71.1 |
| 4,333,196 | 6/1982 | Bougaran | 14/71.7 |
| 4,493,282 | 1/1985 | Ortloff | 114/230 |
| 4,581,784 | 4/1986 | Rousseau et al. | 14/71.1 |
| 4,590,634 | 5/1986 | Williams | 14/71.1 |

FOREIGN PATENT DOCUMENTS

| | | | |
|---|---|---|---|
| 2833357 | of 0000 | Germany | 14/69.5 |
| 40 31 675 C1 | 2/1992 | Germany . | |

*Primary Examiner*—James A. Lisehora
*Attorney, Agent, or Firm*—Harold J. Delhommer; Howrey Simon Arnold & White

[57] ABSTRACT

An improved coupling device for the transfer of personnel or objects between a static and a dynamic structure, such as between an offshore platform and a support vessel, which has two trunnion assemblies and a connecting bridge operating such that the dynamic structure is free to pitch, roll, and move in the horizontal plane with very little of this motion being translated to the connecting bridge. Also, any vertical motion of the dynamic structure, such as rising and falling over waves, is transformed and reduced by an order of magnitude in the same timeframe, when translated to the connecting bridge. Support is provided to one end of the connecting bridge by a trunnion assembly attached to a static structure. This trunnion assembly allows the connecting bridge to rotate around the Y and Z axes relative to the static structure, in a motion similar to a turntable arm. The other end of the connecting bridge is supported by a second trunnion assembly which remains in contact with the dynamic structure and absorbs its pitch, roll, and motions in the horizontal plane, while translating very little of this motion to the connecting bridge. This allows both personnel and objects to be transported between structures in rough seas at times when such transfer might ordinarily be precluded.

50 Claims, 17 Drawing Sheets

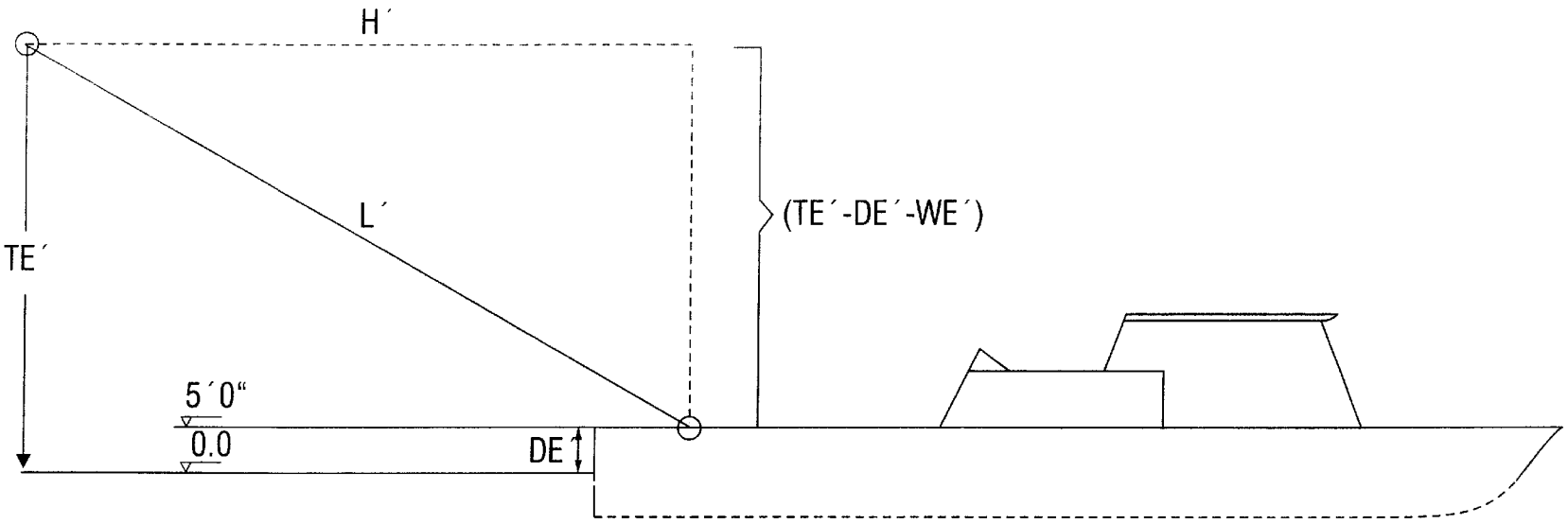

$$\sin\theta - \left(\frac{TE' - DE' - WE'}{L'}\right) \Rightarrow \theta = -\text{Arc}\sin\left(\frac{TE' - DE' - WE'}{L'}\right)$$

$$\cos\theta = \frac{H'}{L'} \Rightarrow H' = L' \times \cos\theta$$

$$\Rightarrow H' = L' \times \cos\left[-\text{Arc}\sin\left(\frac{TE' - DE' - WE'}{L'}\right)\right]$$

$$\triangle H' - H'2 - H'1 = L' \times \cos\left[-\text{Arc}\sin\left(\frac{TE' - DE' - WE2'}{L'}\right)\right] - L' \times \cos\left[-\text{Arc}\sin\left(\frac{TE' - DE' - WE1'}{L'}\right)\right]$$

FIG. 16

COUPLING DEVICE FOR TRANSFER BETWEEN A STATIC STRUCTURE AND A DYNAMIC STRUCTURE

BACKGROUND OF THE INVENTION

The present invention relates generally to a device for transfer between structures and more specifically, to a device for transfer between a substantially static structure and a fully dynamic structure, such as between an offshore platform and a boat.

Several methods have been and are now being used to effectuate transfer between static structures, such as platforms or docks, and fully dynamic structures, such as boats. One such method is a swing rope in which the person to be transferred grasps onto a rope which is tied onto the static structure, and swings from one structure to the other over a gap of water. This maneuver, however, becomes much more difficult to perform as the roughness of the water increases. The resulting acrobatic difficulty of performing this maneuver in rough seas, as well as the necessity of an increased gap between the boat and static structure, may cause this maneuver to become very dangerous and/or impossible to perform. This is because the person attempting to swing on the rope is being moved with the same magnitude and in the same directions as the dynamic structure is moving, and it is much more difficult for a person to judge changes in movement of an object moving toward and away from them, than it is for an object moving laterally across the person's vision.

Also, when the person is attempting to transfer from the dynamic structure to the static structure, the person needs to grasp onto the swing rope at such point in time that the dynamic structure is at its highest elevation, otherwise, the person would be dragged by the dynamic structure. When the person grasps onto the swing rope, the person becomes a human pendulum, because they are free to swing in a vertical plane under the influence of gravitational force only. The length of such human pendulum is determined by the elevation of the dynamic structure when the person decided to grasp onto the swing rope. This length remains constant during the swing(s), and might not properly fit the fixed target of the static structure, causing the person to swing too high or too low.

When the person is attempting to transfer from the static structure to the dynamic structure, the length of the human pendulum (length of the swing rope) is fixed because of the fixed geometry of the static structure. However, the person is swinging to a randomly moving target, and the fixed length of the swing rope might become too short or too long for that specific point in time.

A second means of transfer is the use of a rope ladder suspended from a beam installed on a static structure. By means of a mechanical device, such as a rope, a beam is first forced to rotate to a certain point above the surface of the dynamic structure, such as a vessel's deck. The person being transferred climbs up on the rope ladder to a certain elevation, and the beam is rotated back to the platform. The person then descends from the rope ladder to the static structure, or vice versa. This method is limited first in the fact that the length of the beam is limited by structural considerations. Because the beam can only have a certain length based on the available space on the static structure, the width of the gap of water between the vessel and the platform during rough sea conditions may exceed the maximum length of the beam. This would preclude transfer in these conditions. Also, transferring personnel in this manner depends heavily on the acrobatic skills of the person being transferred. The person needs to be synchronized with the descending-ascending movement of the rope ladder relative to the vessel's deck, resulting from the random motion of the waves. If the person grips the rope ladder at the wrong time, or does not climb fast enough, it is possible that the person can be hit by the vessel's deck during the crest of the wave. Because a person's perception of movements relative to his frame of reference has better resolution to movements contained in a plane normal to his line of sight, rather than movements parallel to his line of sight, a person being transferred may have problems when descending the rope ladder onto the vessel's deck. The person does not have an adequate feedback on how long, how fast, and when his last step to reach the vessel's deck should be. This frequently results in either premature or late last steps, causing the person to fall onto the deck of the vessel.

Another method of transfer is the use of a basket which can be lowered onto a vessel and then lifted. In this method, a crane, which is located on the static structure, can descend a basket onto a vessel's deck and goods or personnel can be loaded onto the basket and lifted onto the structure. This method, which sounds relatively simple, can become very difficult in rough seas where a vessel's deck is moving in many directions at once. Also, if the static structure is unmanned, as is the case with many offshore platforms, this method of transfer is not available for the crane's operator.

A fully floating bridge has also been used to effectuate transfer over water. However, because of the evenly distributed buoyancy of the bridge and its inherent flexibility, the magnitude of movement of the bridge's surface is the same as the magnitude of the waves on the surface. Also, any pitch, roll, horizontal or vertical movement on the buoyant part of the bridge is directly translated to the bridge's surface. Therefore, while transfer of this type may be relatively easy in calm seas, it can be very difficult and perhaps impossible to perform in rough seas.

The transfer between the end of the floating bridge and the vessel's deck also depends heavily on the acrobatic skills of the person being transferred. The person needs to match the randomized and unsynchronized movements of both the bridge and vessel, each having different and independent bouyancies.

Many industries, such as the oil and gas industry, are dependent on offshore operation, and it is very important that personnel and equipment be able to be transferred from a dynamic structure floating on water, such as a boat, and a static structure, such as a dock or offshore platform. Therefore, there is a need for an improved coupling device that can be used effectively in both rough and normal seas, and which adapts to the six degrees of freedom of a dynamic structure and converts them into the smaller horizontal movements of a bridge relative to that dynamic structure. This needs to be done while maintaining stable physical contact between the dynamic structure and the static structure.

SUMMARY OF THE INVENTION

The present invention is directed toward an improved coupling device that satisfies the needs as expressed above. It comprises a first trunnion assembly, which is permanently installed and secured to a static structure, a connecting bridge, which is a self-supporting longitudinal structure mechanically interlocked to the first trunnion assembly at one of its ends, and a second trunnion assembly mechanically interlocked to the other end of the connecting bridge.

The first trunnion assembly is a T-shaped apparatus which provides positive support to and minimizes the movement of a connecting bridge in both the horizontal and vertical planes. This trunnion assembly allows motion around both the Y and Z axes relative to a static structure. Motion around the Z (vertical) axis is allowed by a vertical trunnion, which consists of a vertical shaft inserted inside of a static support shell which is rigidly attached to the static structure. This trunnion is arranged such that the vertical shaft can rotate inside of the static support shell around its longitudinal axis. At the point where friction occurs due to this relative rotation is a material which reduces friction between the two components and results in a reduction of wear and increased mobility between the two components.

The movement around the Y axis is achieved by cylindrical horizontal trunnions, one at each end of a horizontal member which is rigidly attached perpendicularly to the top of the vertical shaft. At each horizontal trunnion, a beam is rigidly connected to a coupling which surrounds each trunnion such that the beam is free to rotate around the horizontal member's longitudinal axis. These beams are then rigidly affixed to an end of the connecting bridge such that the entire bridge can rotate around this axis. In order to effectuate movement between these components, low friction materials, such as poly-olefin sleeves, placed on the outside of the trunnion and the inside of the couplings, as described above, are used as well.

In order to lower friction and wear and improve ease of movement between the first trunnion assembly and the static structure, a trunnion support means can be utilized. One embodiment of this support means has an upper support disc which is rigidly attached longitudinally to the bottom of the horizontal member such that the vertical shaft runs laterally through its center. The support means also has a lower support disc which is rigidly attached to the static support shell, which runs laterally through its center, such that when the vertical shaft rotates relative to the static support shell, the upper support disc rotates relative to the lower support disc and friction is created at a bearing surface between the two discs. In order to reduce friction at this surface, a low friction material may be utilized which will also increase the ease of rotation. One embodiment uses friction reducing polymer bearing discs, rigidly attached to the corresponding side of each support disc, such that friction occurs between the two bearing discs rather than between the support discs.

The connecting bridge, a self-supporting structure, is attached to the first trunnion assembly at one of its ends through the use of beams and connectors, as described above. The bridge itself can have reinforcing structural members in varying designs rigidly affixed along its sides, as well as handrails, if personnel transfer is desired. The connecting bridge is also able to be lowered onto a dynamic structure from a stored position on the static structure, or can be permanently attached between the two structures. The lowering of the connecting bridge can be done through the use of a lifting means, such as a motorized winch, and a cable or rope which is attached to the end of the bridge not attached to the static structure. The connecting bridge can also have a bottom support surface which has a low wind resistance, such as a grating, and the connecting bridge can be constructed of either corrosion resistant or lightweight materials, if necessary.

The beams rigidly attached at the opposite end of the connecting bridge are coupled to the second trunnion assembly. The connections with the connecting bridge are made at pitch trunnions which are located on opposite, outer sides of a first support frame. Beams are coupled to the pitch trunnions through cylindrical bridge couplings, such that the first support frame of the second trunnion assembly can move around a pitch axis relative to the bridge couplings. This allows the dynamic structure to have a pitch motion (tilting from back to forward) around this axis with no such corresponding movement by the connecting bridge.

The first support frame is connected to a second support frame by a mounting rod rigidly attached to the first support frame and running transversely through corresponding openings in the second support frame. The points at which the mounting rod runs through the second support frame are roll trunnions which allow the second support frame to rotate around the mounting rod's longitudinal axis relative to the first support frame. This allows the dynamic structure to have a roll movement with no corresponding torque placed on the first support frame, or the connecting bridge to which it is attached. As described above, a low friction material should be present at the surfaces on the trunnions where motion is taking place. Again, polymer or poly-olefin resin sleeves, such as those constructed from ULTRAPOL® or TEFLON®, can be used to reduce the friction and wear in this area.

When in operation, the bottom surface of the second trunnion assembly's second support frame remains in constant contact with the dynamic structure's surface, and one embodiment can move in a parallel plane relative to this surface. This is accomplished through use of multi-directional rollers connected to the bottom surface of the second trunnion assembly, or any other means of allowing such relative movement at this point of contact. Thus, if the dynamic structure moves in the horizontal plane, the second trunnion assembly will remain in a relatively stable position. Therefore, through the operation of the second trunnion assembly, any horizontal drag (pulling or pushing) forces exerted by the dynamic structure are isolated from the second trunnion assembly and connecting bridge by the multi-directional rollers.

Also, the vertical movements of the dynamic structure will be transformed into smaller angular movements of the connecting bridge by the horizontal trunnions of the first and second trunnion assemblies. The vertical movements of the dynamic structure will not be constrained by the coupling device, therefore, the only vertical forces acting on the vessel's deck will be the combined weight of the second trunnion assembly and the connecting bridge, and the reaction forces induced by the vertical accelerations or decelerations of the dynamic structure caused by the waves.

If the connecting bridge is not permanently attached to the dynamic structure, and can be lowered onto the dynamic structure from a resting position, isolators, such as springs or other shock-absorbing devices, can be used to absorb the impact force of the second trunnion assembly's initial touch-down onto the surface of the dynamic structure. The second trunnion assembly also may use lateral guide rollers to allow the second trunnion assembly to move smoothly along the sides of a dynamic structure, such as the deck of a boat, so that the second trunnion assembly is not hindered in its movements along the side of the target area.

The net result of this invention is that the random movements of the dynamic structure are transformed into smaller angular movements of the connecting bridge in both the vertical and horizontal planes. The movements of the second trunnion assembly relative to the dynamic structure, at the point of contact, are also significantly reduced compared to the movements of the dynamic structure. Since this transformation of movements takes place during the same time frame, the net effect is that the transformed movements have a slow-motion pace. This facilitates a person's entering or leaving the connecting bridge at the dynamic structure's surface.

Therefore, one object of the invention is to provide a novel coupling device for transfer between a static structure and a dynamic structure.

Another object of this invention is to transform or isolate the six degrees of freedom of a dynamic structure, such as a boat (bow-aft, port-starboard, ascend-descend, roll, pitch, and yaw), from a static structure while maintaining a physical contact between the two structures.

Another object of this invention is to provide a solid and reliable structure with handrails that a person can use in a safe manner to walk over the entire gap between two structures, such as between an offshore platform and a support vessel.

Another object of this invention is to provide a device with a slope that can be designed to match the required gap and expected sea conditions in order to have safe transfer under fully dynamic conditions.

Another object of this invention is to transform the ascending-descending movements of a vessel into at least one order of magnitude smaller movements of a connecting bridge, relative to the vessel's deck, within the same time frame, which will facilitate the first or last step of a person boarding or leaving the coupling device at the vessel's deck.

BRIEF DESCRIPTION OF THE DRAWINGS

These and other objects and advantages of the present invention are hereinafter set forth and explained with reference to the drawings, wherein:

FIG. 4(*b*) is a plan view of various embodiments of the connecting bridge support frame.

FIG. 16 shows a schematic for the calculation of the vertical angular position of the connecting bridge.

DESCRIPTION OF ILLUSTRATIVE EMBODIMENTS

Figure 1:
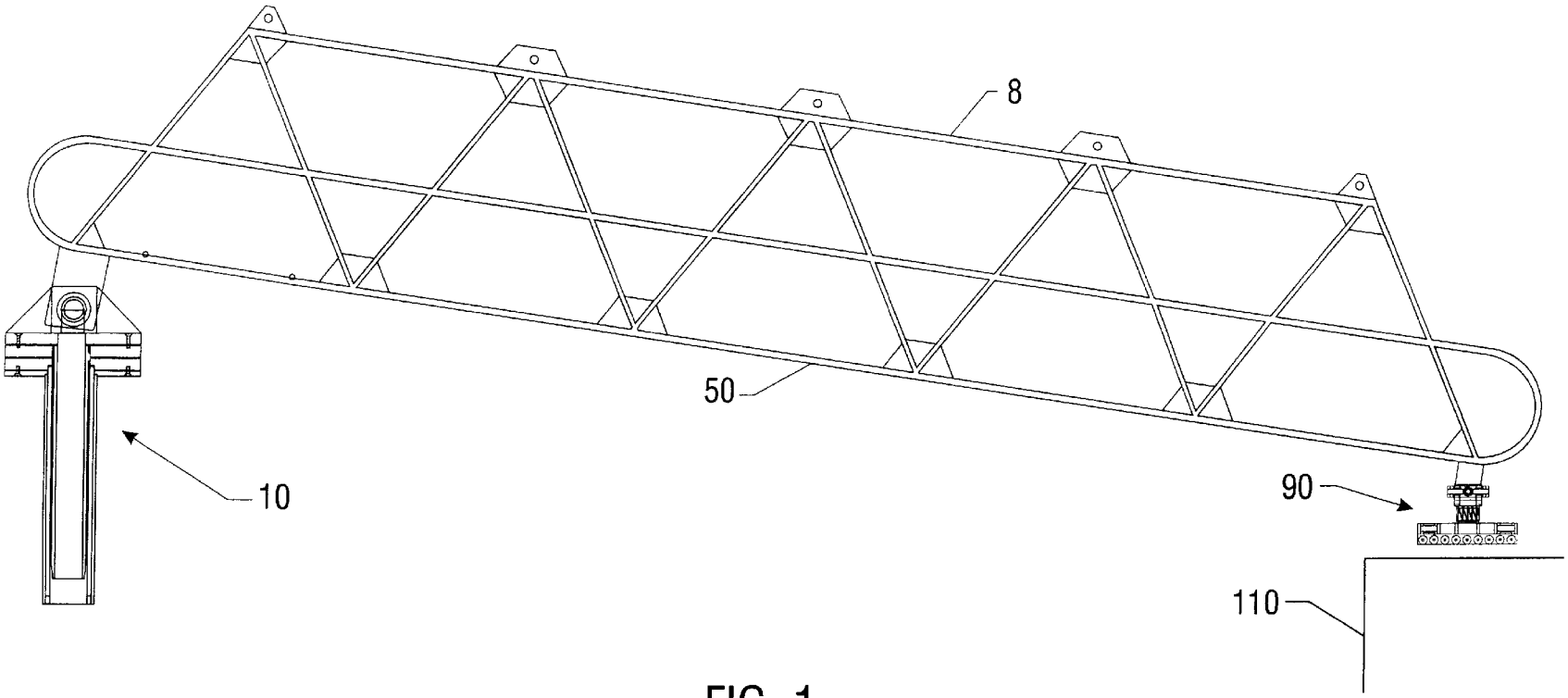
FIG. 1 is a perspective view of a novel coupling device for transfer between a static structure and a dynamic structure.

In FIG. 1, a novel coupling device embodying this invention is generally indicated at 8 and generally comprises a first trunnion assembly 10 pivotally connected to and supporting one end of a connecting bridge 50 in a way which allows motion around the Y and Z axes, as shown, while providing support in all other directions. At the opposite end of connecting bridge 50 is connected second trunnion assembly 90 which provides support for this end of the connecting bridge 50 and is pivotally attached in such a way that the second trunnion assembly 90 is allowed to rotate around the X and Y axes relative to the connecting bridge, and can move in a parallel plane relative to a dynamic surface 110.

First Trunnion Assembly

Figure 2:
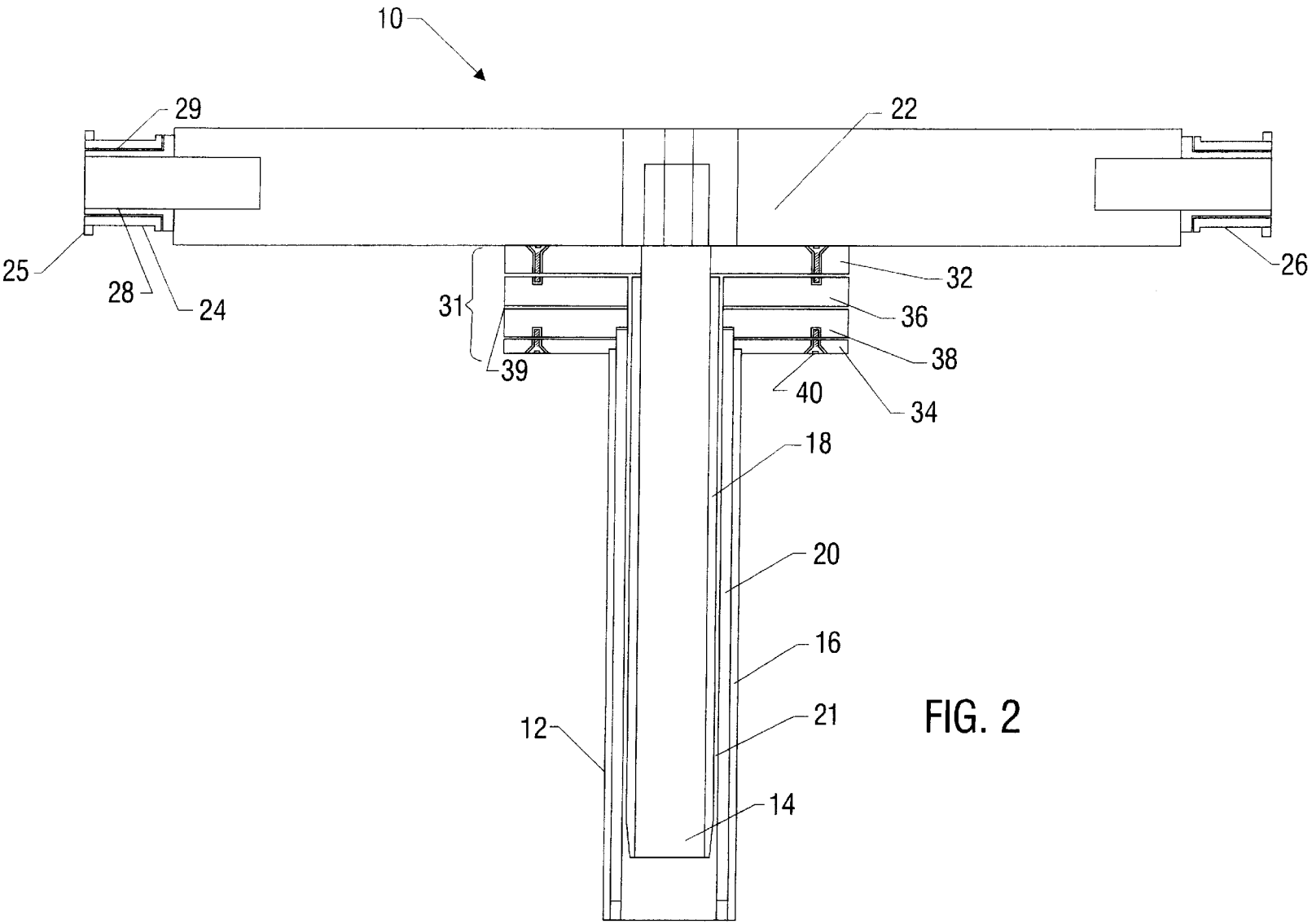
FIG. 2 is a front view of the first trunnion assembly, which is installed on the static structure, showing both the vertical and horizontal trunnions.
Figure 15:
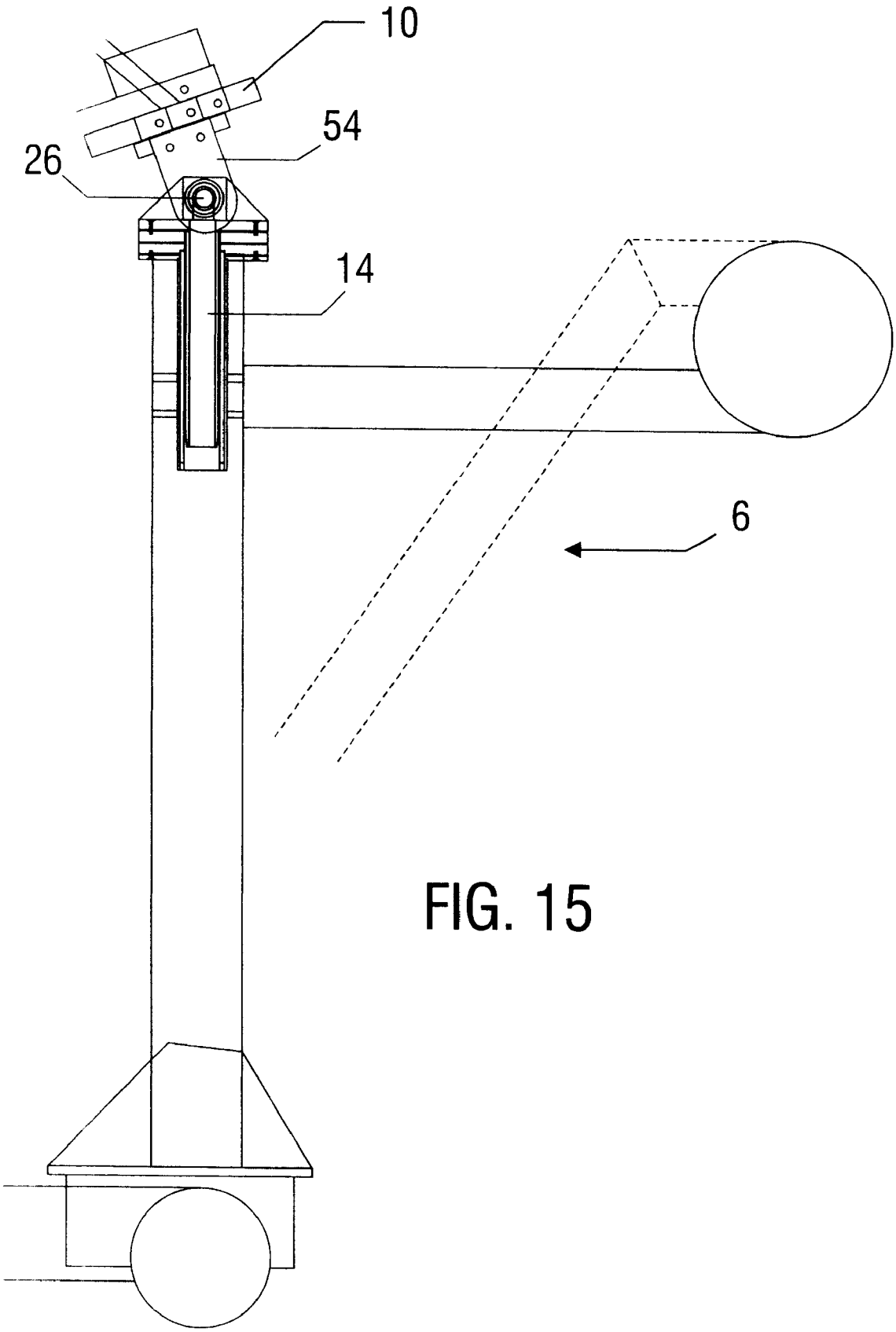
FIG. 15 shows one method of connecting the first trunnion assembly to a static structure.

The first trunnion assembly 10, as shown in FIG. 2, may be T-shaped, and comprises both a vertical trunnion 12 and one or more horizontal trunnions 24 and 26. The first trunnion assembly 10 is pivotally connected to the connecting bridge 50, and allows it to move only around the Y and Z axes while providing support in all other directions. To analogize the movement of the trunnion assembly as coupled to the connecting bridge, it acts like a turntable arm. The first trunnion assembly 10 may be attached to a static structure in a variety of ways known in the art, with one such way being illustrated in FIG. 15. The particular means of attachment used depends upon the configuration of the static structure, the type of operation being performed, as well as other factors dependent on the particular kind and geographic area of use.

Vertical trunnion 12 is comprised of a vertical shaft 14 which may be housed inside of static support shell 16. Both of these components may be cylindrical so as to make relative motion between the two easier. In this embodiment, the vertical shaft 14 is allowed to rotate inside of static support shell 16, which remains stationary, and can be permanently attached to a static structure. The point at which friction occurs between these two components is the vertical bearing surface 21, where a lubricating or friction lowering material, such as oil, bearings, or a polymeric material, can be present. This will maintain a low degree of friction and wear at said bearing surface. In one embodiment, sleeves of self-lubricating polymer or poly-olefin resins, such as TEFLON® or ULTRAPOL®, a poly-olefin made by Corel, can be used. In this embodiment, a self-lubricated sleeve 18, made of ULTRAPOL®, is placed around the outside of vertical shaft 14, and a self-lubricated bearing 20, also made of ULTRAPOL®, is placed inside of the static support shell 16 such that the vertical bearing surface 21 is two ULTRAPOL® surfaces meeting each other. An embodiment of this uses ULTRAPOL® sleeves approximately ⅜" thick, and provides an area of low friction such that the trunnion assembly 10 can operate for an extended period of time with reduced wear and smoother movement between the components.

Figure 4:
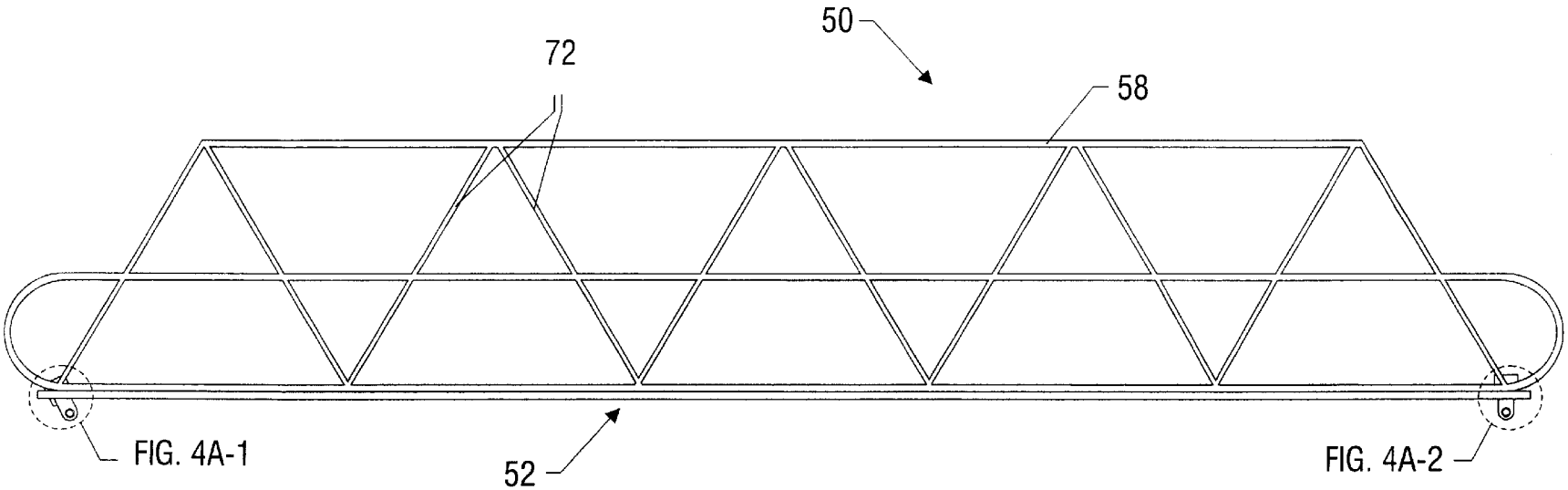
FIG. 4(*a*) is an elevation view of one embodiment of the connecting bridge, illustrating both support beams and handrails.
Figures 2, 4A:
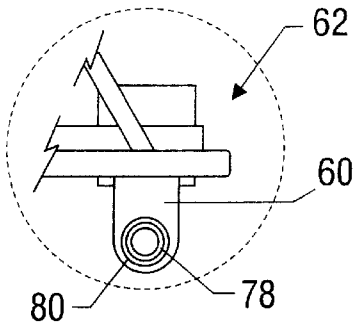
Figures 1, 4A:
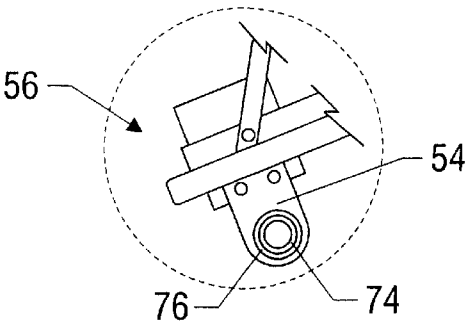
Figures 1, 4B:
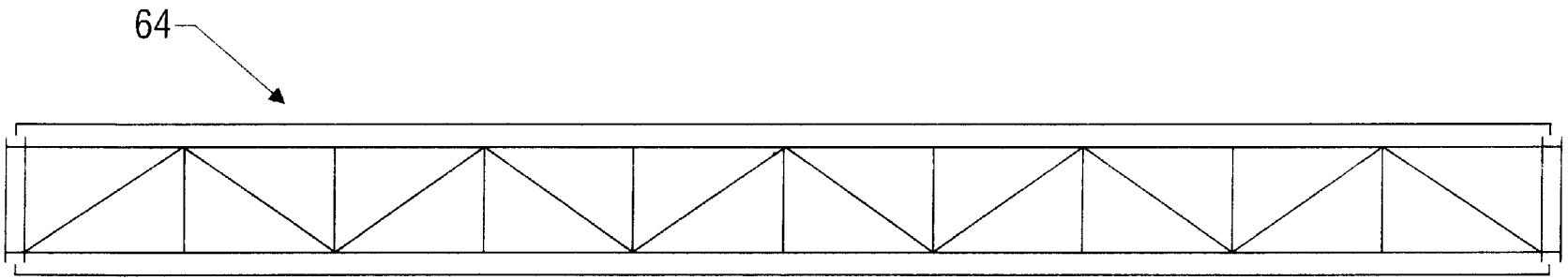
Figures 2, 4B:
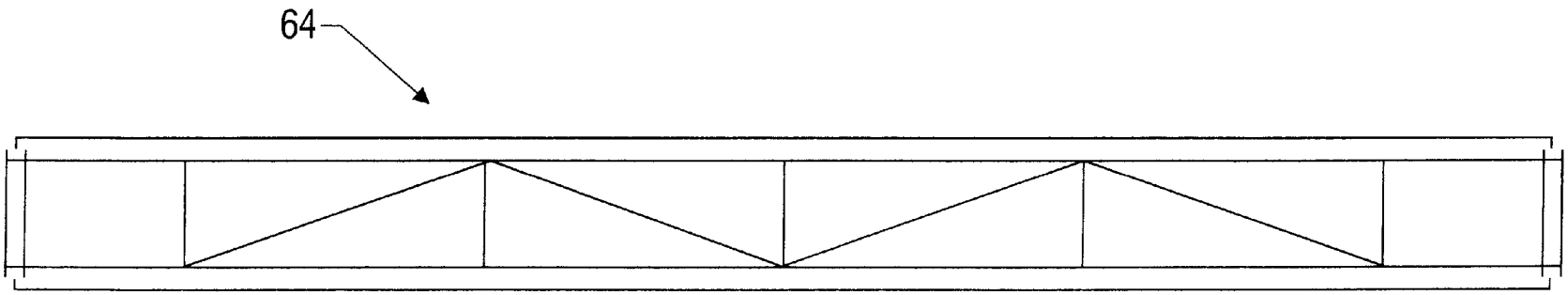

The trunnion assembly 10 also comprises a horizontal member 22 which is rigidly and perpendicularly affixed to vertical shaft 14 such that said vertical shaft and horizontal member 22 are not allowed to move relative to each other. Said horizontal member 22 contains one or more horizontal trunnions 24 and 26. In one embodiment, as shown in FIG. 2, said horizontal member has one horizontal trunnion at each of its ends, these being a left horizontal trunnion 24 and a right horizontal trunnion 26. At these trunnions is is 5 attached trunnion connection beam 60 rigidly affixed at one end to couplings 62, such beams being rigidly affixed at an opposite end to a connecting bridge 50, as shown in FIG. 4(*a*). The horizontal trunnions 24 and 26 allow the trunnion connection beams 60 and coupling 62 to rotate around the longitudinal axis of horizontal member 22, thus allowing connecting bridge 50 to rotate around the same axis. In one embodiment, each horizontal member has a lip 25 at its far end, as shown in FIG. 2, in order to prevent said trunnion connection couplings 62 from slipping off the ends of the horizontal trunnions 24 and 26.

The point at which the horizontal trunnions meet the trunnion connection couplings 62 is horizontal bearing surface 29. Materials resulting in low friction and wear when these components rotate relative to each other are helpful at this point. As with the vertical trunnion 12, one embodiment of the horizontal trunnion uses horizontal trunnion sleeve 28, made of ULTRAPOL®, affixed around the horizontal trunnions. A sleeve of this type can also be placed on the inside of the trunnion connection couplings 62 such that there is a low amount of friction and wear and increased ease of movement at the horizontal bearing surfaces 29.

Figure 3:
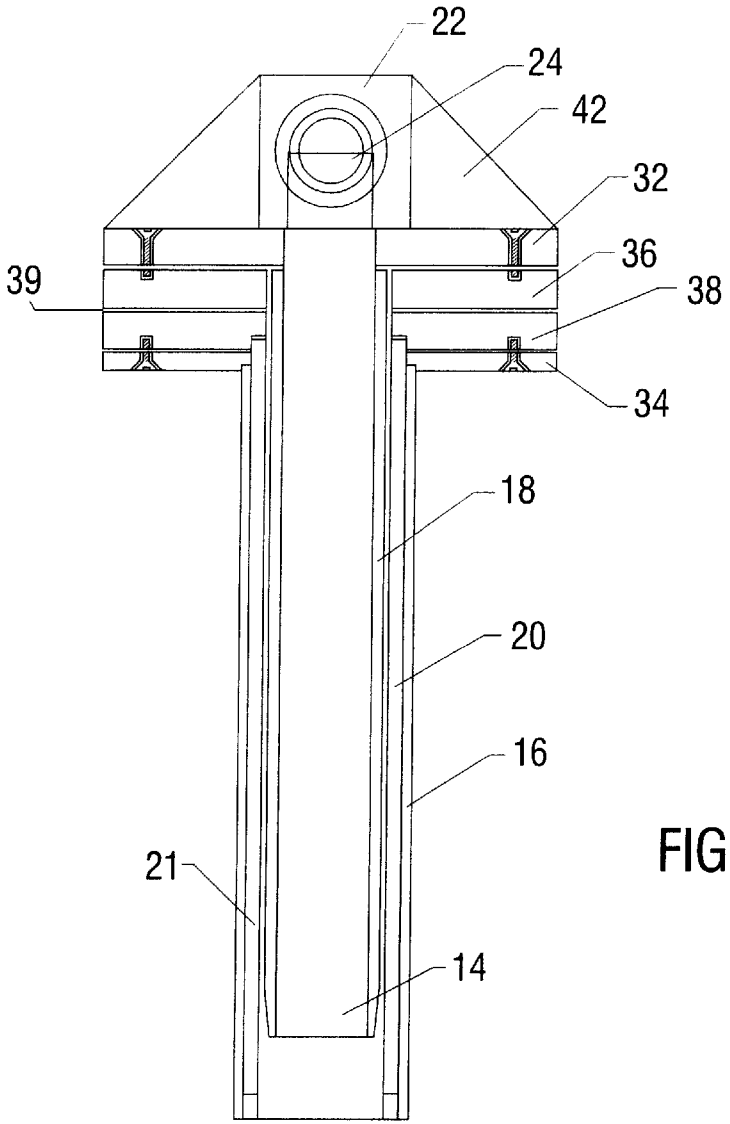
FIG. 3 is a side view of the first trunnion assembly.

The embodiment shown in FIGS. 2 and 3 also comprises a trunnion support means 31. Said support means contains an upper support disk 32 which is rigidly and longitudinally attached to the horizontal member by welding, bolts, glue or other attachment means, and is located perpendicular to vertical shaft 14 which runs through said upper support disk. The upper support disk may also be rigidly connected to the vertical shaft 14. In the embodiment shown in FIG. 3, said vertical shaft 14 runs perpendicularly through said horizontal rotation support disk, which is disc-shaped in one embodiment, but can be of varying shapes. Said support means 31 also contains a lower support disc 34 which is rigidly and perpendicularly attached to static support shell 16. Said lower support disk 34 can also be disc-shaped, with said static support shell 16 running through the center of the lower support disc in a perpendicular direction. At the point at which the upper support disc 32 and lower support disk 34 interface, the bearing surface 39, the vertical trunnion 12 and horizontal member 22 will rotate around the longitudinal axis of static support shell 16. At this bearing surface 39, a friction lowering material may be placed so as to minimize friction and wear between the two components. In one embodiment, an upper and lower bearing disc, 36 and 38, respectively, made of ULTRAPOL® or another low friction polymer, may be used. In the embodiment shown in FIG. 2, the upper bearing disk 36 is affixed to the upper support disk 32 through the use of bolts 40, or other adhesive materials, such as glue or nails. A lower bearing disk 38 is attached to the lower support disk 34 in the same manner. In this way, the bearing surface 39 at which rotation occurs, will be made up of low friction materials in order to create smooth movement between the components.

As shown in FIG. 3, one embodiment of the trunnion assembly contains a plurality of stabilizing plates 42 which are rigidly affixed to both the horizontal member 22 and upper support disk 32. Said stabilizing plates reinforce the stability of the horizontal member and counteract the torque placed on this member by its rotation so that the entire assembly is made more stable, and its long term effectiveness is increased. In the embodiment shown in FIG. 3, the two stabilizer plates are triangle-shaped, but any shape or number which provides sufficient stability is acceptable.

Connecting Bridge

Shown in FIG. 4(*a*) is a connecting bridge 50 with a self-supporting frame that needs only to be supported at its two ends when in an operational position. The connecting bridge consists of a bottom support surface 52 which should be a substantially flat surface able to support either objects or personnel traveling across its length. One embodiment uses a metal grating as a bottom support surface in order for the apparatus to be operational in an environment where a low wind resistance is necessary. This embodiment may have grates which are small enough to transfer either objects or personnel, while large enough to have decreased wind resistance. For this type of operation, it is preferred that there be approximately 2 inches between grates. The bottom support surface may also have any width sufficient for transfer, and a width of approximately 3 feet is preferred for the transfer of personnel. The bottom surface also has a length which will be determined by the application for which it is designed. In an embodiment where transfer is being made between an offshore platform and a support vessel, the preferred length is approximately 45 feet.

Figure 8:
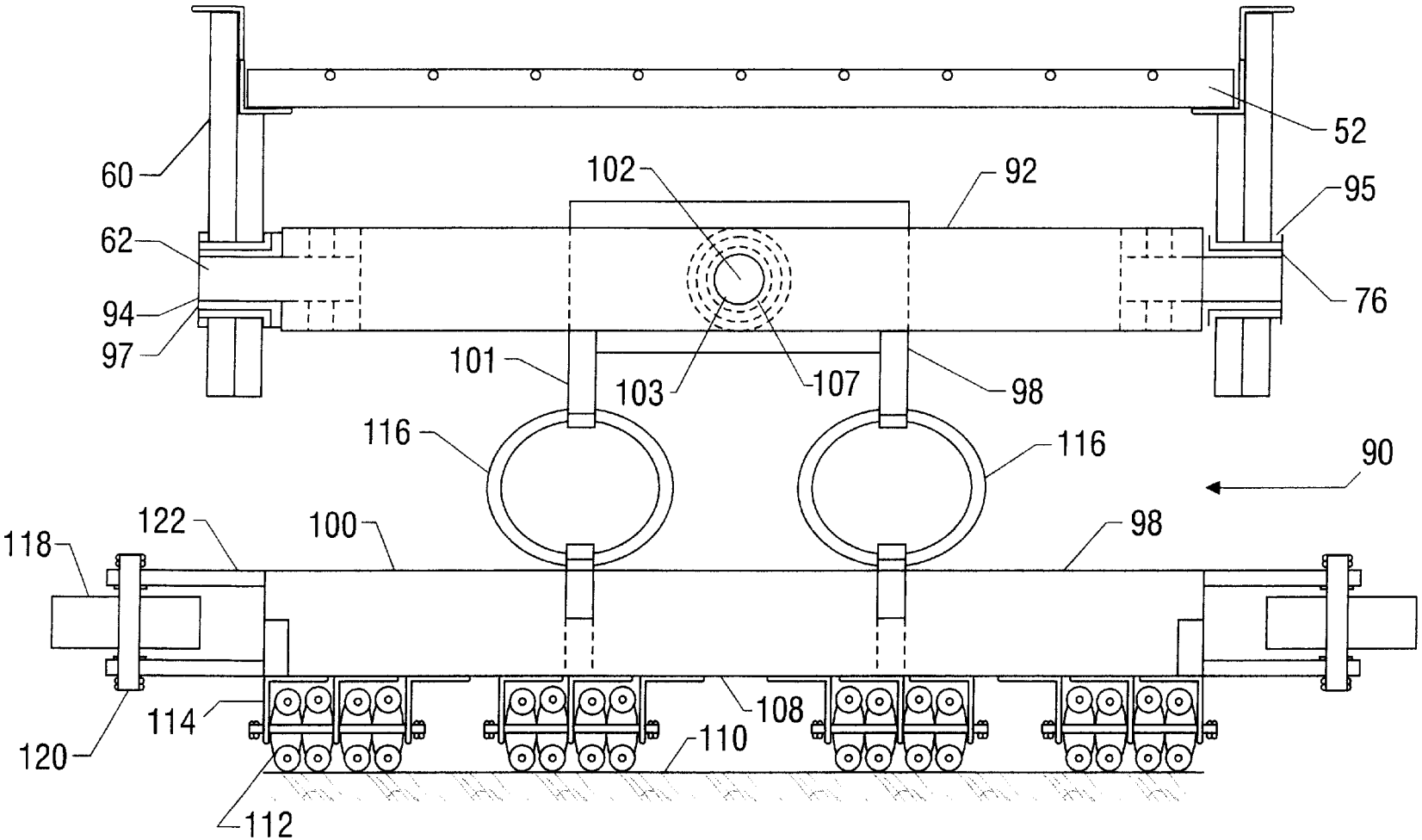
FIG. 8 is a front view of an embodiment of the second trunnion assembly having isolators, lateral guide rollers, and multi-directional wheels.

At each end of the bottom support surface 52 are a plurality of first trunnion and second trunnion connecting beams 54 and 60, respectively. These beams should be rigidly affixed to the bottom support surface 52 or other area on the connecting bridge. For example, welding or bolting would be a sufficient means of attachment. Each connecting beam has a means of attaching to a horizontal trunnion 24 or pitch trunnion 94, as shown in FIG. 8, such that relative motion is allowed between said trunnions and connecting beams. One embodiment of this is the use of first and second trunnion couplings, 56 and 62, respectively, which are rigidly affixed to said connecting beams 54 and 60 and surround said trunnions such that relative rotation is allowed. It is preferred that these couplings be cylindrical and hollow, such as a pipe. Each set of couplings 56 and 60 have inner coupling surfaces 74 and 78 where relative rotation and, hence, friction occurs. As in embodiments discussed before, low friction materials, such as coupling sleeves 76 and 80 made of ULTRAPOL®, may be inserted inside of the couplings in order to reduce friction at the coupling surfaces.

In the embodiment shown in FIG. 4(*a*), the bottom support surface 52 can be connected to a support frame 64 which is affixed to each side of the bottom support surface and runs along its length. This support frame can be truss-shaped, as shown in FIG. 4(*b*), or any other shape such that additional support is provided to said bottom support surface 52. A plurality of support beams 72 can also be attached on each side of the bottom support surface, such that additional support for said surface 52 is provided. Many different embodiments of support frame 64 can be used, as shown in FIG. 4(*b*), and a particular design can be chosen based on the specific application for which the apparatus is to be used. Running along the top of said support beams 72 and parallel to bottom support surface 52 can be a horizontal support beam 58 which provides additional support to the structure.

Figure 5:
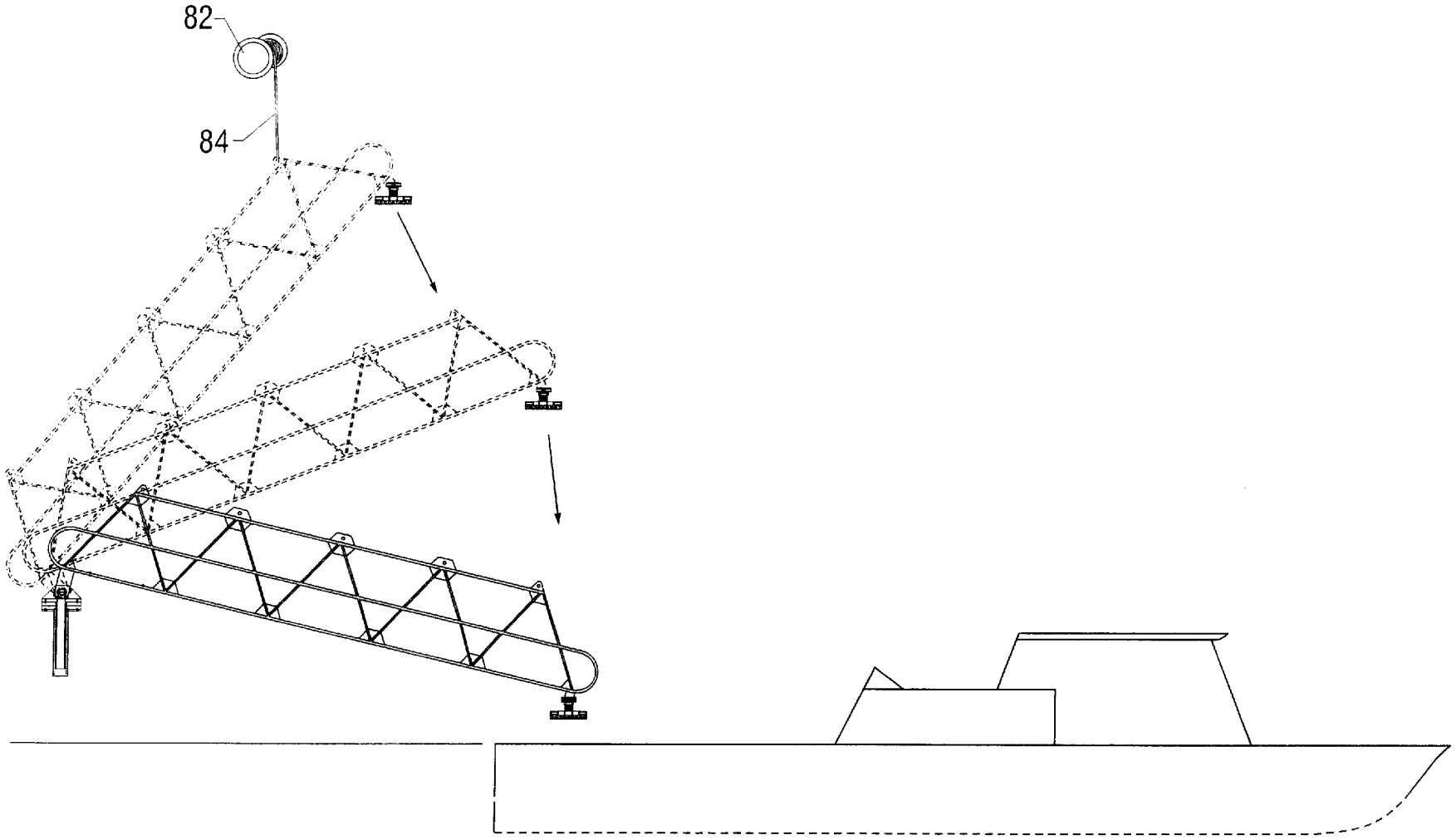
FIG. 5 illustrates the descending sequence of a movable connecting bridge toward the target area on a vessel's deck.
Figure 6:
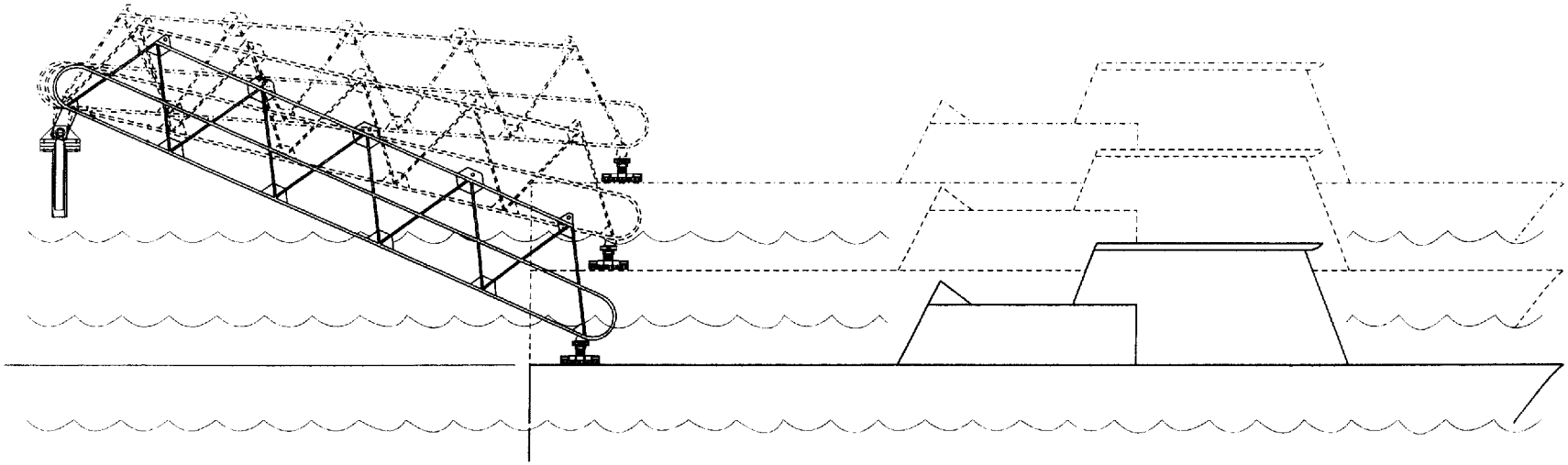
FIG. 6 illustrates an embodiment of the connecting bridge in the operational position resting on the target area of a vessel's deck, as well as the displacement of the connecting bridge relative to the displacement of the vessel's deck.
Figure 7:
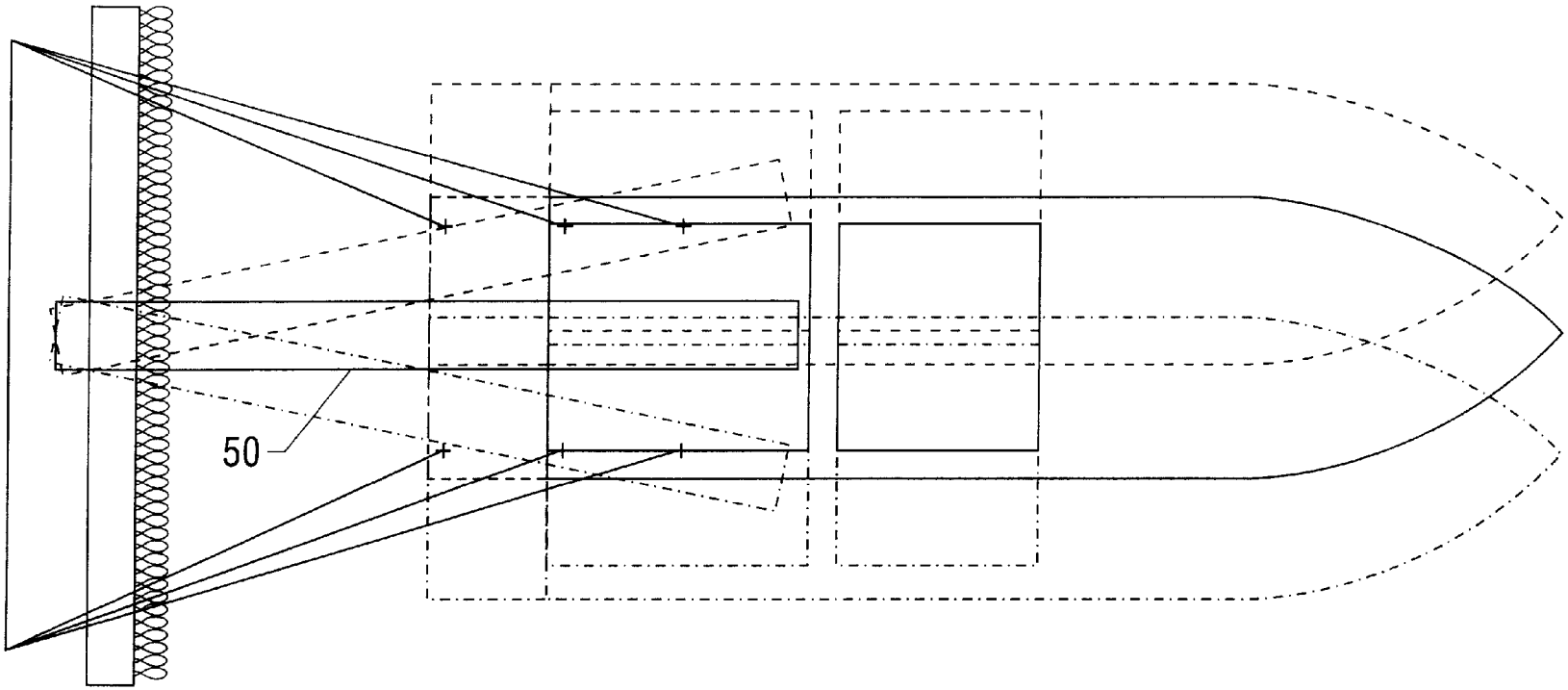
FIG. 7 is a plan view of a partially constrained vessel at three different positions with the corresponding target areas, as well as a plan view of the connecting bridge.

As shown in FIG. 5, an embodiment of this apparatus allows for it to be lowered from a storage position into an operational position, such as onto the back of a boat. In one such embodiment, a lifting means 82, such as a motorized winch, can lift a cable 84 is which is pivotally attached to one end of the connecting bridge. In this way, the apparatus can be stored in an upright position when not in use, and easily lowered into an operational position when necessary. FIG. 6 illustrates an embodiment of the apparatus in operational position resting on a target area on the vessel's deck, and further illustrates the displacement of the connecting bridge relative to the displacement of the vessel's deck. A further illustration of this embodiment is shown in FIG. 7 which demonstrates the effect of the lateral displacement of the vessel on the connecting bridge.

Connecting bridge 50 can be constructed of any self-supporting rigid materials such that it can support the weight of the objects to be transported. It is preferable, however, to use a lightweight material, such as aluminum, fiberglass, or graphite. If the apparatus is to be used in a corrosive environment, corrosion resistant materials, such as stainless steel or aluminum, may also be used. The connecting bridge 50, however, can be constructed of any material which is rigid when supported at both ends such that the connecting bridge can support the weight of transferred objects.

Second Trunnion Assembly

Figure 13:
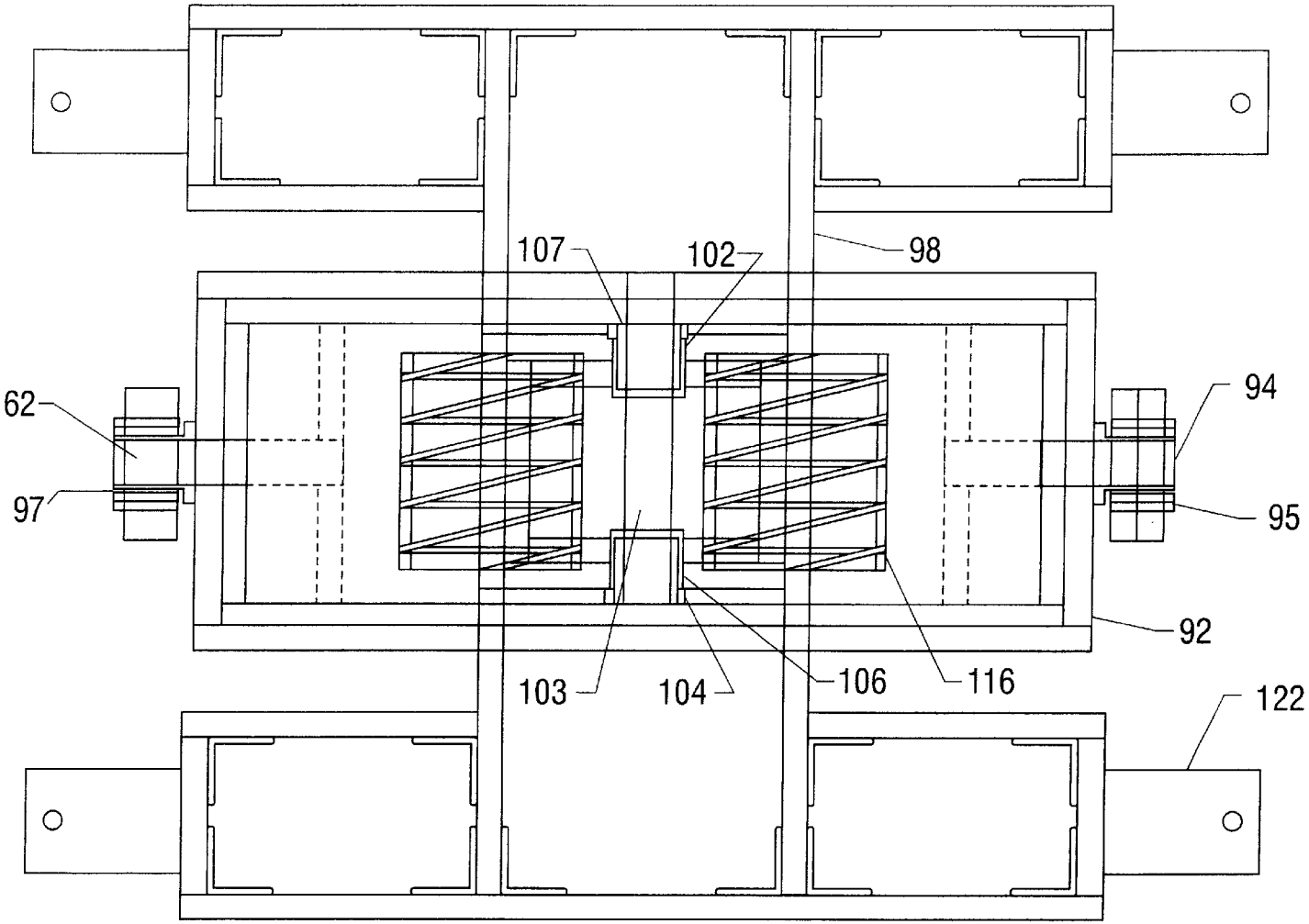
FIG. 13 shows a top view of an embodiment of the second trunnion assembly.

Shown in FIG. 8 is an embodiment of a second trunnion assembly 90 which is used to transform the motion of a dynamic structure, such as pitch, roll, yaw, and movement in the horizontal and vertical planes, into smaller angular motions of connecting bridge 50 in both the vertical and horizontal planes. Said second trunnion assembly is comprised of a first support frame 92, to which said connecting bridge 50 is attached, and a second support frame 98, which maintains parallel contact with a dynamic structure's surface 110. Said first support frame, as shown in FIG. 13, may be rectangularly shaped with one embodiment having pitch trunnions 94 on the outside of two of its opposite sides. Connecting beams 60, which arc rigidly attached to the connecting bridge, are pivotally attached to said pitch trunnions in such a way that said beams are allowed to rotate around the longitudinal axis of said pitch trunnions. In one embodiment, this motion is accomplished through the use of couplings 62, as described above. Said pitch trunnions 94 can have a lip 95 located on the end of each pitch trunnion which prevents couplings 62 from slipping free. Said pitch trunnions can also have sleeves 97 made out of a material such as ULTRAPOL® placed on their outer surfaces, so that there is a low amount of friction and wear at rotation surface 76.

Figure 10:
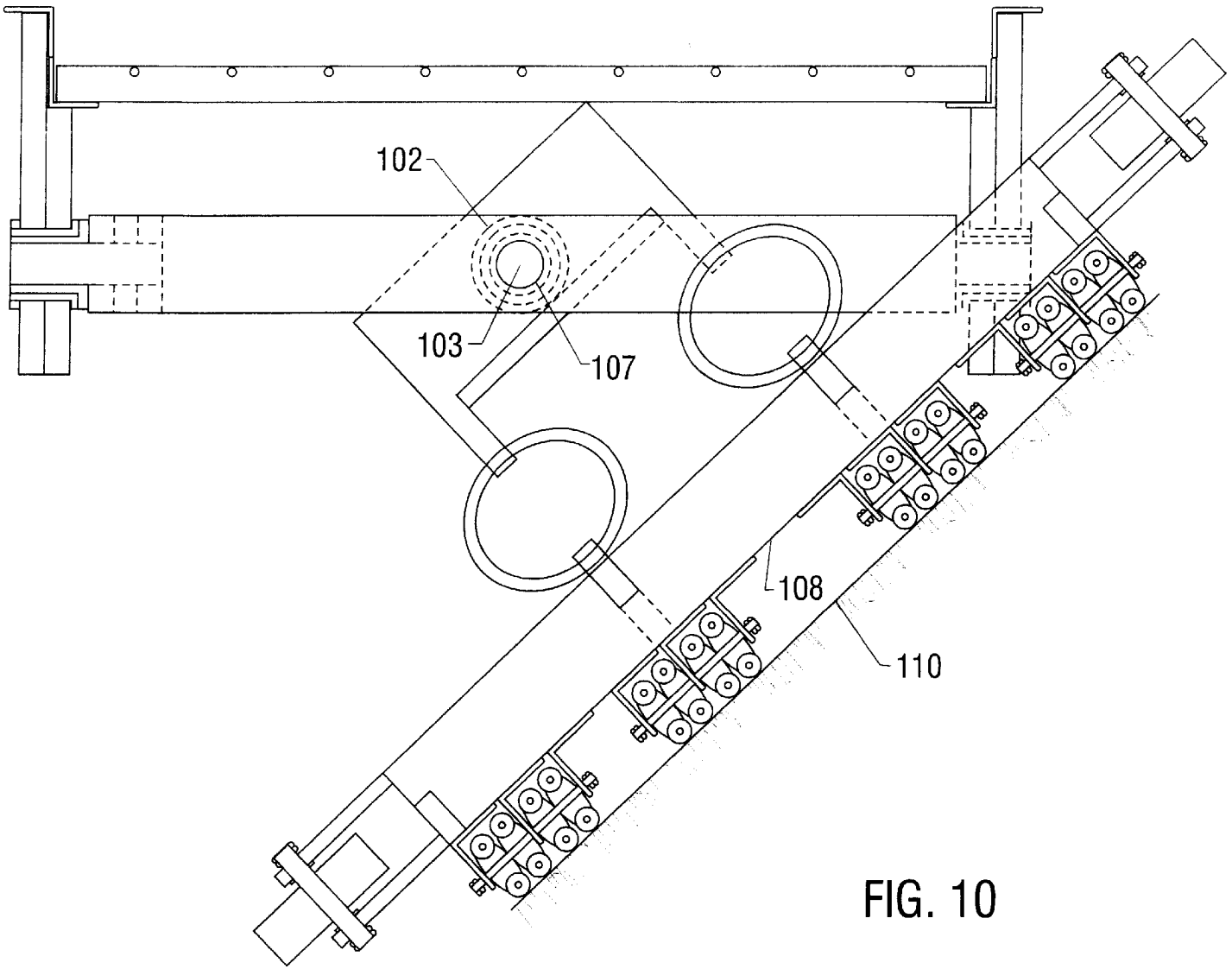
FIG. 10 shows a front view of this embodiment of the second trunnion assembly absorbing roll from the dynamic structure around the roll axis, with the corresponding non-roll-displacement of the connecting bridge.
Figure 11:
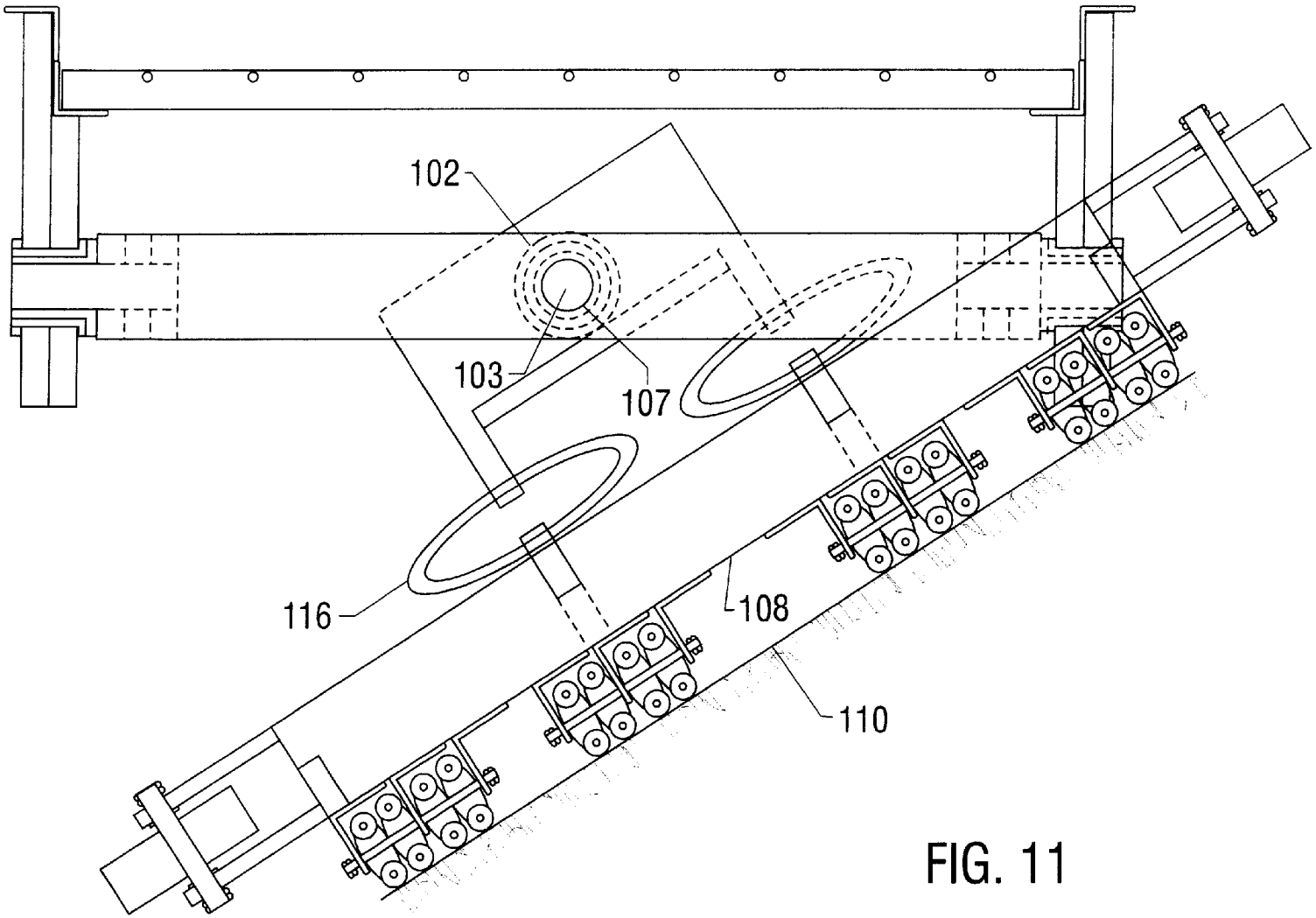
FIG. 11 shows a front view of this embodiment of the second trunnion assembly absorbing both shock loading and rolling conditions.

Second trunnion assembly 90 also comprises a second support frame 98 comprised of a lower section 100 and upper section 101. First support frame 92 is attached to upper section 101 of second support frame 98 through a roll trunnion 102, as shown in FIG. 13. This roll trunnion 102 allows the second support frame 98 to rotate around the transverse axis of said first support frame 92, as shown in FIG. 8, such that said second support frame 98 can be subjected to a roll motion while none of this motion is transmitted to said first support frame 92, as shown in FIG. 10. Said roll trunnion 102 is comprised of a mounting rod 103, preferably cylindrical, which runs transversely through the center of the first support frame 92, as seen in FIG. 13. Said mounting rod 103 may be rigidly affixed to said first support frame such that no relative motion is allowed between the two. As seen in FIG. 8, the upper section 101 of the second support frame is shaped so that said mounting rod 103 runs transversely through it and provides support in both the horizontal and vertical planes. However, the second support frame 98 is pivotally affixed to said mounting rod in a way such that the second support frame is able to rotate around the longitudinal axis of said mounting rod 103, as shown in FIG. 10. In this way, the second support frame 98 can be rotated around the mounting rod's axis with no corresponding torque placed on the first support frame 92.

The point of contact between the upper section 101 of the second support frame 98 and the mounting rod 103 is a roll rotation surface 107 at which friction occurs. As with the previously disclosed trunnions, a low friction material can be used on this surface to minimize friction and wear due to rotation between the two components. As shown in FIG. 13, a mounting rod sleeve 104, made of ULTRAPOL® or other low friction material, and a second support frame sleeve 106 placed at the points where the second support frame meets the mounting rod can result in less friction and wear being recognized at the roll rotation surface 107.

Figure 14:
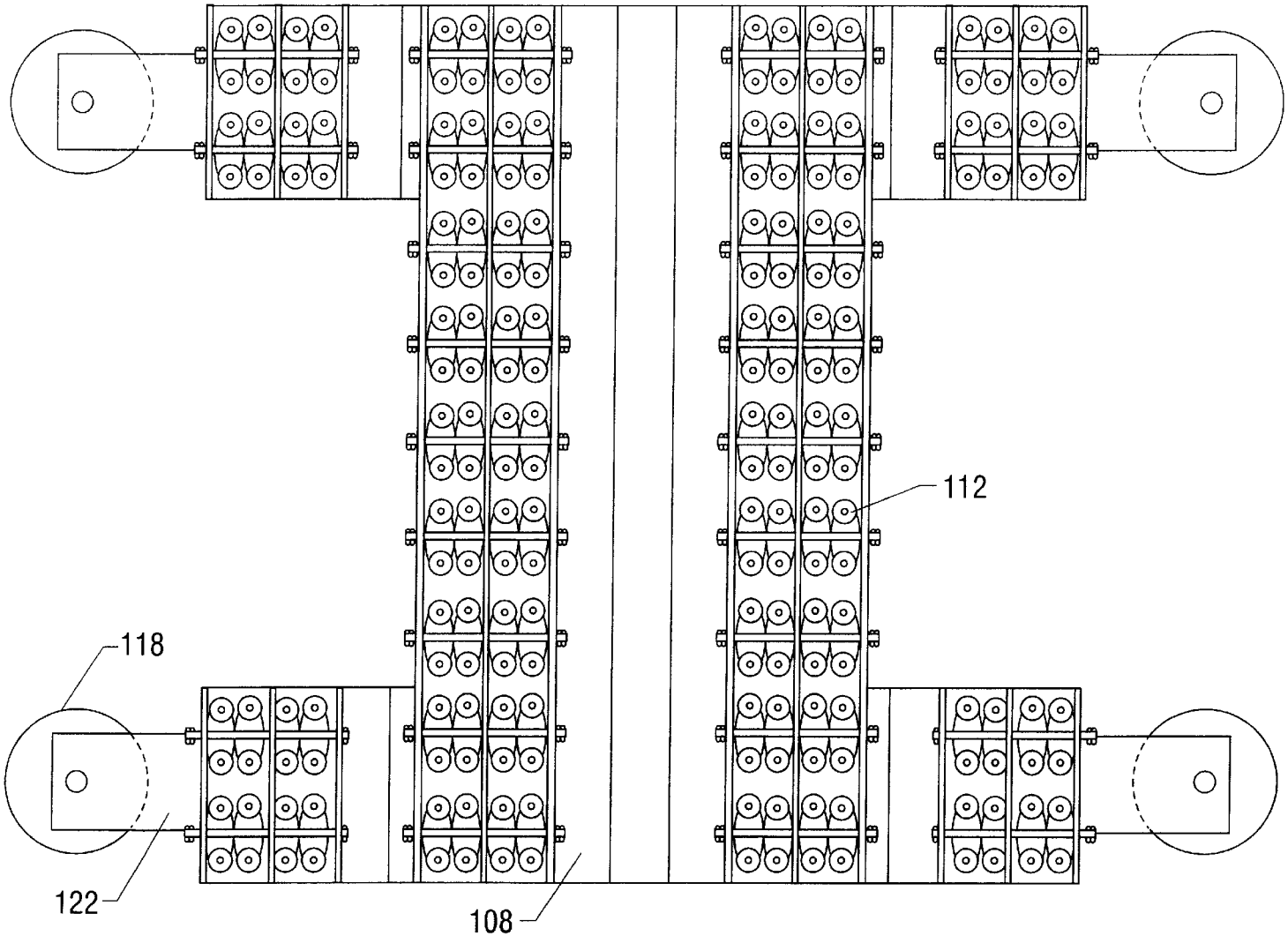
FIG. 14 shows the bottom view of an embodiment of the second trunnion assembly.

Second support frame 98 has a bottom surface 108 which, when in operation, maintains a parallel orientation relative to a dynamic structure's surface 110. Said bottom is 5 surface 108 also maintains constant contact with the dynamic structure's surface 110, either directly or indirectly through another component, such as multi-directional wheels 112, as shown in FIGS. 8 and 14. Bottom surface 108 may contact dynamic structure surface 110 in such a way that said bottom surface 108 is allowed to move parallel to said dynamic structure surface. This is accomplished by the placement of a roller means, such as oil, rollers, bearings, wheels, or other components that would allow such relative motion, onto said bottom surface 108. The embodiment shown in FIG. 8 uses a plurality of multi-directional wheels 112 which are mounted to said bottom surface 108 through the use of a plurality of attachment means, such as brackets 114. The use of such components allows a dynamic structure's surface, such as the deck of a boat, to move in any plane while translating very little of that motion to said second trunnion assembly. In this way, if, for example, the second trunnion assembly is placed on the deck of a boat, the magnitude of the horizontal movement of the boat is not fully translated to the second support frame 98, which then translates even less of this motion to the connecting bridge 50, which remains substantially stable.

Figure 9:
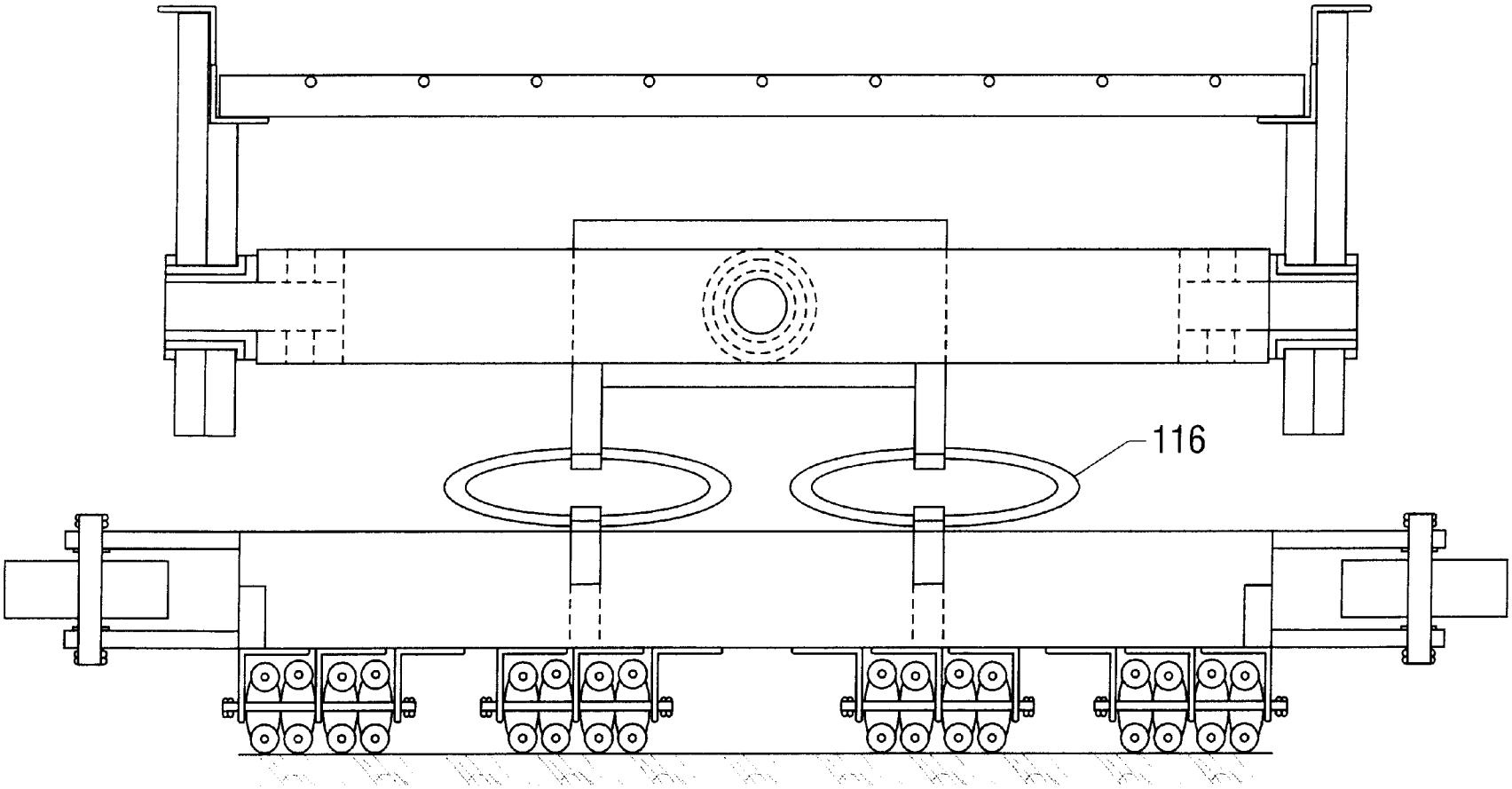
FIG. 9 shows an embodiment of the second trunnion assembly under maximum shock load conditions.
Figure 12:
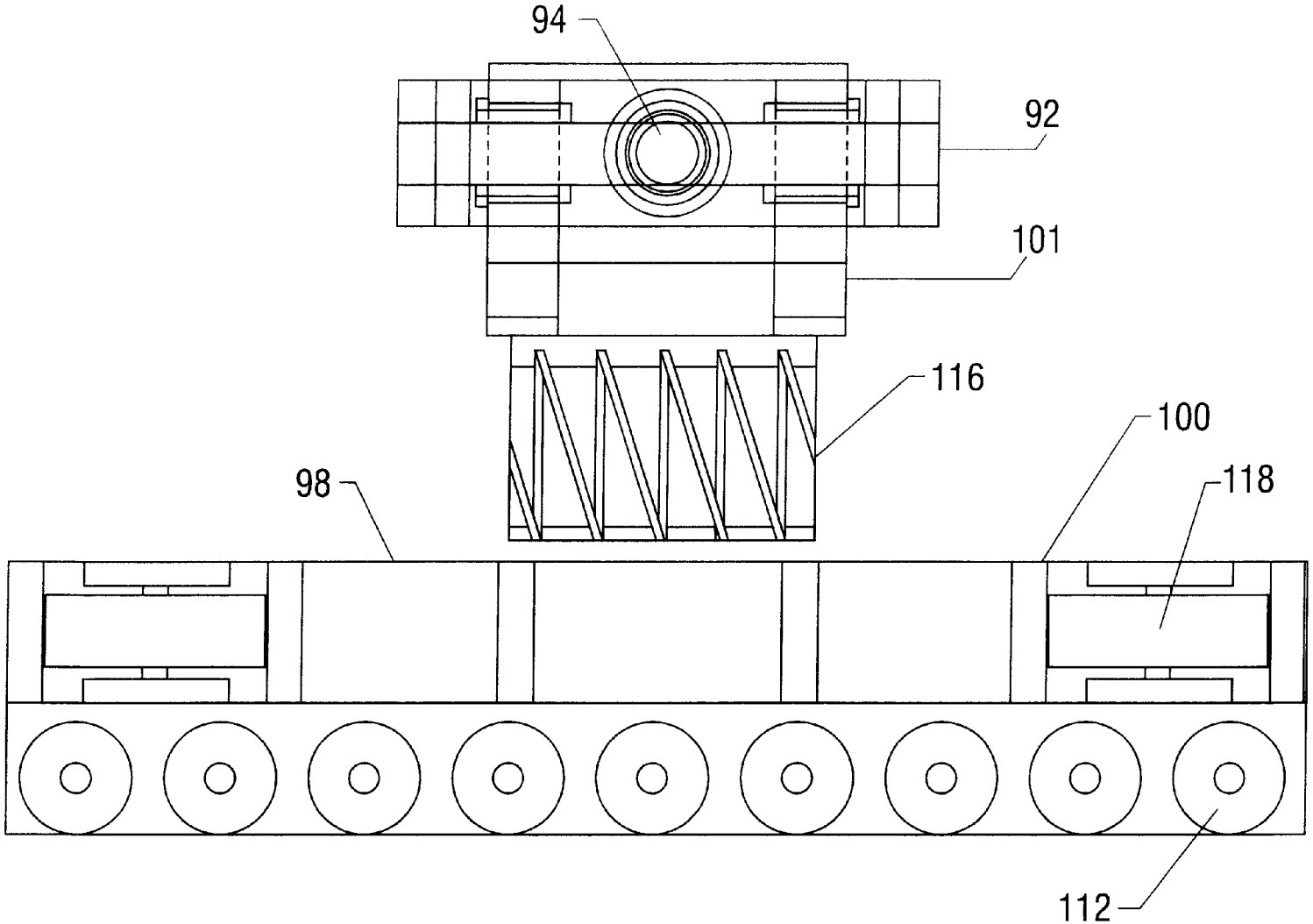
FIG. 12 shows a side view of this embodiment of the second trunnion assembly.

As seen in FIGS. 8 and 9, one embodiment of second trunnion assembly 90 contains isolators 116 for use with a lowerable design as shown in FIG. 5. Said isolators can be mounted on the second support frame 98 such that they are located in between upper section 101 and lower section 100, and rigidly affixed to each. Said isolators perform such that any shock received by the lower section 100 of the second support frame, such as when the second trunnion assembly 90 impacts the deck of a boat upon lowering onto a target area, is absorbed by the isolators and is not fully translated to said upper section 101 or said first support frame 92, as shown in FIG. 9. The isolators can be manufactured from any shock-absorbing material, such as springs, foam, plastic, or polymers. As shown in FIG. 12, one embodiment uses a stainless steel spring manufactured by Aeroflex set on its side and rigidly attached to and between the upper and lower sections of the second support frame 98. Said attachment can be made by using brackets or any other mounting means such that said isolators 116 are firmly affixed to both sections of the second support frame 98.

As shown in FIG. 8, one embodiment may also comprise a lateral guide means for allowing relative movement between the sides of a dynamic surface, such as the deck of a support vessel, and the second trunnion assembly 90. The embodiment shown uses a plurality of lateral guide rollers 1 18 attached to the sides of the lower section 100 of second support frame 98. Said lateral guide rollers 1 18 can be attached through the use of brackets 122, which are rigidly affixed to the sides of the second support frame 98, and a pin 120 running laterally through both the lateral guide roller 118 and bracket 122. Other means of attachment are acceptable as long as smooth motion between the second trunnion assembly and the sides of a dynamic structure is allowed. The purpose of said lateral guide rollers 118 or other such means is to allow the second trunnion assembly 90 to maintain its presence in a target area, such as the deck of a support vessel, without being hung up on the sides of the vessel if it moves a great deal. These rollers perpetuate smooth movement of the second trunnion assembly down the sides of the support vessel.

As discussed previously, the second trunnion assembly may be constructed of various materials, depending upon the particular application needed. Lightweight materials, such as aluminum, and corrosion resistant materials, such as stainless steel, can again be used, as long as they can withstand the corresponding stresses caused by the use of the apparatus in particular situations.

All parts of the novel coupling device, except for the previously mentioned friction reducing components, can be constructed of various materials depending upon the environment in which the assembly is to be used. If the apparatus is placed in an area where weight is a concern, the assembly can be made of aluminum, fiberglass, graphite, or other low weight materials with sufficient strength for operation. If the apparatus is to be used in a corrosive environment, such as in offshore operations, materials with low corrosive propensities may be used, such as stainless steel. The disclosure of these materials is not limited to the ones specifically stated, but should be read to include all materials which can sufficiently support the apparatus while meeting the needs of the individual user.

It will be readily understood by those skilled in the art that novel coupling device 8 provides distinct advantages over previous coupling devices, such advantages including the following:

(a) The novel coupling device converts the wild movements of a fully dynamic structure in six directions (X, Y, Z, roll, pitch, and yaw) into small angular movements of a connecting bridge in both the vertical and horizontal planes. The vertical angular position of the connecting bridge is given by the formula $\theta=-\text{Arc Sin}(TE'-DE'-WE'/L')$, where TE' equals the elevation of the horizontal trunnions of the first trunnion assembly above the calm sea level, DE' equals the elevation of the vessel's deck above the vessel's flotation line, WE' equals the elevation of the wave at a given moment, and L' equals the length of the connecting bridge, as seen in FIG. 16.

Because the connecting bridge has a fixed length, the vertical movements of the dynamic structure will be converted into horizontal movements of the second trunnion assembly parallel to the deck of the dynamic structure. These horizontal movements are at least one order of magnitude smaller than the vertical movements of the dynamic structure. To analogize the horizontal movement of the second trunnion assembly relative to the vessel's deck, it acts like a floor polishing machine moving at a slow pace.

The horizontal movement of the second trunnion assembly relative to the vessel's deck, produced by the vertical movement of the vessel, is given by the formula:

$$\Delta H'=H2'-H1'$$

$$H1'=L'\times\text{Cos}[-\text{Arc Sin}((TE'-DE'-WE1')/L')]$$

$$H2'=L'\times\text{Cos}[-\text{Arc Sin}((TE'-DE'-WE2')/L')]$$

where ΔH' is the change in horizontal position of the second trunnion assembly relative to the vessel's deck (expressed in feet), and WE1' is the wave's elevation (expressed in feet) at a given instant 1, and WE2' is the wave's elevation (expressed in feet) at a given instant 2.

For example, with a connecting bridge having a length of 45 feet (L'=45 ft), operating in 10 foot waves, with the horizontal trunnions of the first trunnion assembly being elevated 10 feet above the calm sea level (TE'=10 ft), and with a deck elevation of 6 feet above the flotation line (DE'=6 ft), the connecting bridge's vertical angular position will fluctuate from:

$\theta1=-\text{Arc Sin}(10'-6'-(-5'))/45')=-11.5°$ for the trough (WE'=−5'), and $\theta2=-\text{Arc Sin}(10'-6'-(+5'))/45')=+1.20$ for the crest (WE'=+5').

Therefore, the vertical angular position of the connecting bridge will fluctuate from −11.5° for the trough to +1.2° for the crest, and the maximum angular change of position will be only 12.7°. Converting this angle to height at a particular point on the connecting bridge through the formula $V=L\times\sin\theta$, where V equals the vertical displacement of the connecting bridge, L equals a distance along the length of the bridge, and θ equals the change of angular position, the vertical displacement of a person at the dynamic structure would be 10', while their displacement at the center of the connecting bridge is only 5 feet. This displacement decreases to only 0.22 feet when the person is standing one foot from the static structure. Thus, the effect of 10' waves on a person standing on the connecting bridge is much smaller than the effect that they would have on a person standing on a vessel's deck.

In this same example, the change in horizontal position of the second trunnion assembly produced by the change in elevation of the vessel because of the 10 foot waves will be:

$$\Delta H'=H2'--H1'$$

| | |
|---|---|
| crest: | H1' = L' × Cos [−Arc Sin ((TE' − DE' − WE1')/L') |
| | H1' = 45' × Cos [−Arc Sin ((10' − 6' −(+5'))/45')] = 44.99', and |
| trough: | H2' = L' × Cos [−Arc Sin ((TE' − DE' − WE2')/L') |
| | H2' = 45' × Cos [−Arc Sin ((10' − 6' −(−5'))/45')] = 44.09'. |

Therefore, ΔH'=H2'−H1'=44.99'−44.09'=0.9'=10.8 inches.

Thus, the change in horizontal position of the second trunnion assembly relative to the vessel's deck, produced by the 10 feet tall waves, will be only 10.8 inches. Thus, horizontal movements of the boat, as well as roll and pitch are absorbed by the first and second trunnion assemblies and are not transformed to the connecting bridge at a magnitude sufficient to preclude transport of objects or personnel in rough seas.

(b) Use of the coupling device results in safer transport of personnel because the movements of the connecting bridge are mainly lateral in nature, i.e. from side to side, rather than back and forth like a swing rope. These lateral movements are much easier to adjust to by a person attempting to travel from a boat to a static structure. For a person that is standing on the vessel's deck, and is attempting to climb on the novel coupling device, his/her perception of the second trunnion assembly's movement will be like the slow-motion paced floor polishing machine described above.

As soon as the person steps on the second trunnion assembly, the only relative movements of the connecting bridge that the person will perceive are the roll and pitch angular movements of the bridge relative to the second trunnion assembly. When the person is standing on the connecting bridge, they will feel only the small vertical and horizontal motions of the connecting bridge. Centrifugal forces generated by the angular movements of the connecting bridge in the vertical and horizontal planes might also be noticed. No roll movements will be felt in this frame of reference. During the person's walk through the connecting bridge towards the static structure, the magnitude of the movements will become smaller until the person reaches the static structure. The movements of the connecting bridge with the greatest magnitude are thus at the point of attachment with the dynamic structure. Therefore, if a person were to fall at this point, they would fall on the deck of the boat rather than into the water.

(c) This novel coupling device is also much more efficient than previous devices because it allows for transfer in rough seas, where transfer would be precluded with other devices. Therefore, objects which may not be able to be reached in rough seas, such as offshore platforms, can be reached by using this device and a monetary savings can thus be recognized through increased and more efficient production.

The present invention, therefore, is well adapted to carry out the objects and attain the ends and advantages mentioned, as well as others inherent therein. While presently preferred inventions have been given for the purpose of disclosure, numerous changes in the details of construction and arrangement of parts will be readily apparent to those skilled in the art, and are encompassed within the spirit of the invention and the scope of the appended claims.

What is claimed is:

1. A coupling device for transfer between a substantially static structure and a dynamic structure, the coupling device comprising:

a connecting bridge;

a first trunnion, pivotally attached to a static structure such that said first trunnion is allowed to rotate around a vertical axis relative to said static structure, and pivotally attached to a first end of the connecting bridge such that said connecting bridge can rotate around a horizontal axis relative to said first trunnion, while said first trunnion provides support to the connecting bridge in all other directions;

a second trunnion, pivotally connected to a second end of the connecting bridge and able to remain in substantially parallel contact with a surface of a dynamic structure, said second trunnion comprising a roll trunnion, said roll trunnion allowing the second trunnion to accept rotation of more than a total of 16° around a roll axis, and a separate pitch trunnion, such that said second trunnion rotates with the roll and pitch motion of said dynamic structure's surface without translating these motions to said connecting bridge.

2. The coupling device of claim 1 wherein said coupling device is manufactured from materials having lightweight properties comprising aluminum, fiberglass, graphite, or other such materials having lightweight properties.

3. The coupling device of claim 1 wherein said coupling device is manufactured from materials having corrosion resistant properties comprising aluminum, stainless steel, treated steel, polymers, or other materials having corrosion resistant properties.

4. The coupling device of claim 1 further comprising a friction-reducing means for the reduction of friction and wear at the pivotal connection points between the connecting bridge and the first and second trunnion means.

5. The coupling device of claim 4 wherein the friction-reducing means comprises a plurality of sleeves comprised of poly-olefin or a polymeric material.

6. The coupling device of claim 1 further comprising a lifting means for raising and lowering a first end of the coupling device wherein a second end remains pivotally affixed to a static structure.

7. The coupling device of claim 6 wherein said lifting means comprises a winch and a tether comprising a rope, cable, or wire pivotally attached to said first end of the coupling device.

8. The coupling device of claim 1 wherein said connecting bridge is constructed of self-supporting materials, such that said connecting bridge remains rigid when supported only at its first and second ends.

9. The coupling device of claim 8 wherein said connecting bridge further comprises a bottom surface.

10. The coupling device of claim 9 wherein said bottom surface is constructed of grating material.

11. The coupling device of claim 9 wherein said connecting bridge further comprises support means for providing additional strength to said bottom surface, said support means being rigidly affixed to said bottom surface.

12. The coupling device of claim 11 wherein said support means comprises rigid beams attached at one end to and running laterally upward from said bottom surface and affixed to a top portion of a support frame comprising a top and a bottom portion, said bottom portion affixed to at least one longitudinal side of said bottom surface and said top portion oriented parallel to and longitudinally above said bottom portion.

13. The coupling device of claim 12 wherein said support frame comprises a handrail for providing a place for persons to grip when traveling across said connecting bridge.

14. The coupling device of claim 1 wherein said second trunnion further comprises:

a bottom surface which, when engaged with the surface of a dynamic structure, remains in substantially parallel contact with the surface of a dynamic structure, and a roller means for allowing relative movement between said bottom surface and said dynamic structure's surface in all directions of a plane parallel to the surface of said dynamic structure, and affixed to said bottom surface such that substantially parallel contact between the two said surfaces is maintained.

15. The coupling device of claim 14 wherein said roller means comprises a plurality of multi-directional wheels.

16. The coupling device of claim 14 wherein said second trunnion further comprises a lateral guide means affixed to said second trunnion, such that relative motion between the second trunnion and side walls of a dynamic structure is allowed when said second trunnion contacts said side walls.

17. The coupling device of claim 16 wherein said lateral guide means comprises a plurality of wheels, attached longitudinally to the sides of the second trunnion.

18. The coupling device of claim 1 wherein said second trunnion further comprises a first support frame and a second support frame, said second support frame comprising an upper portion and a lower portion, wherein an isolator is attached between said upper and lower portions, and wherein a shock traveling upward through the lower portion is substantially dampened by said isolator before reaching said upper portion.

19. The coupling device of claim 18 wherein said isolator means comprises a spring.

20. The coupling device of claim 1 wherein the second trunnion can be lowered onto and removed from said dynamic structure.

21. The coupling device of claim 1 wherein the rotation of said first trunnion around said horizontal and vertical axes occurs within the same vertical plane.

22. The coupling device of claim 1 wherein said second trunnion further comprises an isolator means.

23. A coupling device for transfer between a substantially static structure and a dynamic structure comprising:

a first trunnion assembly comprising a vertical trunnion which allows said first trunnion assembly to rotate around a vertical axis while restricting its movement in all other directions, said vertical trunnion comprising a static support shell rigidly attached to a static structure, and a vertical shaft adjacent to said static support shell, wherein said vertical shaft can rotate about a longitudinal axis of said static support shell and relative to said static support shell;

a horizontal member attached to said vertical shaft such that said horizontal member rotates with said vertical shaft, said horizontal member comprising a horizontal trunnion rigidly attached at each of its ends;

a connecting bridge pivotally connected at one end to said horizontal trunnions of said first trunnion assembly such that said connecting bridge can rotate around both a vertical and horizontal axis relative to said static structure, the connecting bridge also being pivotally connected at its opposite end to a second trunnion assembly such that said second trunnion assembly allows rotation around both the roll and pitch axes relative to said connecting bridge;

said second trunnion assembly comprising a first support frame and a second support frame, said second support frame having upper and lower sections, said second trunnion assembly further comprising:

a roll trunnion, connecting said first and second support frames such that said second support frame is allowed to rotate more than 16° around a roll axis relative to said first support frame, and a pitch trunnion affixed to the first support frame, said pitch trunnion being pivotally affixed to the connecting bridge such that said second trunnion assembly can rotate around the pitch axis relative to the connecting bridge.

24. The coupling device of claim 23 further comprising a friction reducing means which reduces both friction and wear and increases the ease of rotation at the horizontal and vertical trunnions of the firs t trunnion assembly, said friction reducing means comprising a plurality of sleeves fitted to the individual rotation points such that all rotational friction occurs between said sleeves.

25. The coupling device of claim 23 further comprising a friction reducing means which reduces both friction and wear and increases the ease of rotation at the roll and pitch trunnions of the second trunnion assembly, said friction reducing means comprising a plurality of sleeves fitted to the individual rotation points such that all rotational friction occurs between said sleeves.

26. The coupling device of claim 24 or 25, said plurality of sleeves being comprised of a polymer or poly-olefin material.

27. The coupling device of claim 23 wherein said connecting bridge comprises a self- supporting bottom structure.

28. The coupling device of claim 23 wherein said roll trunnion further comprises a mounting rod running transversely through said first support frame, said mounting rod also passing through said upper section of the second support frame such that the second support frame is supported by the mounting rod and the second support frame is allowed to rotate around the longitudinal axis of said mounting rod, relative to said first support frame.

29. The coupling device of claim 23 wherein said first trunnion assembly further comprises a trunnion support means, comprising an upper support disk longitudinally attached to the horizontal member and laterally encircling the vertical shaft, the trunnion support means further comprising a lower support disk rigidly attached to the static support structure such that said static support shell travels laterally through the center of said lower support disk, said upper disk contacting said lower disk at a bearing support surface wherein rotation of said upper disk occurs relative to said lower disk.

30. The coupling device of claim 29 wherein said trunnion support means further comprises a friction reducing means at said bearing support surface, such that all rotational friction occurs in the presence of said friction reducing means.

31. The coupling device of claim 30 wherein said friction reducing means comprises an upper bearing disk attached to said upper support surface, and a lower bearing disk attached to said lower support disk, wherein said rotation occurs between said upper and lower bearing disks.

32. The coupling device of claim 31 wherein said upper and lower bearing disks are comprised of a polymer or poly-olefin material.

33. The coupling device of claim 23 further comprising a friction reducing means which reduces both friction and wear and increases the ease of rotation at the horizontal and vertical trunnions and bearing support surface of said first trunnion assembly, and at the roll and pitch trunnions of said second trunnion assembly, said friction reducing means comprising a plurality of sleeves fitted to the individual rotation points such that all rotational friction occurs between said sleeves, said sleeves being comprised of a polymer or poly-olefin material.

34. A trunnion assembly comprising a first support frame and a second support frame, said trunnion assembly further comprising:

a roll trunnion having a mounting rod running transversely through said first support frame and being attached to the first support frame, said mounting rod also passing through an upper section of the second support frame such that the second support frame is supported by the mounting rod and the second support frame is allowed to rotate more than 16° around the longitudinal axis of said mounting rod relative to said first support frame, and a pitch trunnion affixed to the first support frame, said pitch trunnion being pivotally affixed to a connecting bridge such that said second trunnion assembly can rotate around a pitch axis relative to the connecting bridge.

35. The trunnion assembly of claim 34 further comprising a friction reducing means which reduces both friction and wear and increases the ease of rotation at the roll and pitch trunnions of the novel trunnion assembly, said friction reducing means comprising a plurality of sleeves fitted to the individual rotation points such that all rotational friction occurs between said sleeves, these sleeves being comprised of a polymer or poly-olefin material.

36. The apparatus of claim 23 or 34 wherein the second trunnion assembly further comprises an isolator means for absorbing forces through the bottom surface of said second trunnion assembly.

37. The apparatus of claim 36 wherein said isolator means comprises a plurality of springs.

38. The apparatus of claim 23 or 34 wherein the second trunnion assembly further comprises a lateral guide means for allowing the second trunnion assembly to move along the sides of a dynamic structure's surface when engaged with such sides.

39. The apparatus of claim 38 wherein said lateral guide means comprises a plurality of rollers affixed to the second support frame.

40. The coupling device of claim 23 or the trunnion assembly of claim 34 wherein said second trunnion assembly further comprises a bottom surface which, when engaged with the surface of a dynamic structure, remains in substantially parallel contact with the surface of the dynamic structure, and a roller means for allowing relative motion between said bottom surface and said dynamic structure's surface in all directions of a plane parallel to the surface of said dynamic structure, and affixed to said bottom surface such that substantially parallel contact between the two said surfaces is maintained.

41. The apparatus of claim 40, said roller means comprising a plurality of multi-directional wheels affixed to said second trunnion assembly's bottom surface.

42. A coupling device for transfer between a substantially static structure and a dynamic structure comprising:

a first trunnion assembly comprising:

a vertical trunnion which allows said first trunnion assembly to rotate around a vertical axis while restricting its movement in all other directions, said vertical trunnion comprising a vertical shaft inserted longitudinally into a static support shell, said static support shell being rigidly attached to a static structure, such that said vertical shaft can rotate inside of said static support shell around its longitudinal axis;

a horizontal member attached to said vertical shaft such that said horizontal member rotates with said vertical shaft, said horizontal member comprising a horizontal trunnion rigidly attached at each of its ends, to which a connecting bridge is pivotally attached such that said connecting bridge can freely rotate around the longitudinal axis of said horizontal member;

a trunnion support means comprising an upper support disk longitudinally attached to the horizontal member and laterally encircling the vertical shaft, the trunnion support means further comprising a lower support disk rigidly attached to the static support structure such that said static support shell travels laterally through the center of said lower support disk, said upper disk contacting said lower disk at a bearing support surface wherein rotation of said upper disk occurs relative to said lower disk;

a connecting bridge comprising a self-supporting bottom structure, said connecting bridge being pivotally connected at a first trunnion end to the first trunnion assembly such that said connecting bridge can rotate around both a vertical and horizontal axis relative to a static structure, the connecting bridge also being pivotally connected at a second trunnion end to a second trunnion assembly such that said second trunnion assembly allows rotation around both the roll and pitch axes relative to said connecting bridge;

said second trunnion assembly comprising a first support frame and a second support frame, said second support frame having upper and lower sections, said second trunnion assembly further comprising:

a roll trunnion having a mounting rod running transversely through said first support frame, said mounting rod also passing through said upper section of the second support frame such that the second support frame is supported by the mounting rod and the second support frame is allowed to rotate more than 16° around the longitudinal axis of said mounting rod, relative to said first support frame, and a pitch trunnion affixed to the first support frame on its outer sides, said pitch trunnion being pivotally affixed to the connecting bridge such that said second trunnion assembly can rotate around the pitch axis relative to the connecting bridge.

43. A coupling device for transfer between a substantially static structure and a dynamic structure, the coupling device comprising:

a connecting bridge;

a first trunnion, pivotally attached to a static structure such that said first trunnion is allowed to rotate around a vertical axis relative to said static structure, and pivotally attached to a first end of the connecting bridge such that said connecting bridle can rotate around a horizontal axis relative to said first trunnion, while said first trunnion provides support to the connecting bridge in all other directions;

a second trunnion, pivotally connected to a second end of the connecting bridge and able to remain in substantially parallel contact with a surface of a dynamic structure, said second trunnion comprising a roll trunnion and a separate pitch trunnion such that said second trunnion rotates with the roll and pitch motion of said dynamic structure's surface without translating these motions to said connecting bridge, said second trunnion further comprsing:

a bottom surface which, when engaged with the surface of a dynamic structure, remains in substantially parallel contact with the surface of a dynamic structure, and a roller means for allowing relative movement between said bottom surface and said dynamic structure's surface in all directions of a plane parallel to the surface of said dynamic structure, and affixed to said bottom surface such that substantially parallel contact between the two said surfaces is maintained.

44. The coupling device of claim 43 wherein said roller means comprises a plurality of multi-directional wheels.

45. The coupling device of claim 43 wherein said second trunnion further comprises a lateral guide means affixed to said second trunnion, such that relative motion between the second trunnion and side walls of a dynamic structure is allowed when said second trunnion contacts said side walls.

46. The coupling device of claim 45 wherein said lateral guide means comprises a plurality of wheels attached longitudinally to the sides of the second trunnion.

47. A coupling device for transfer between a substantially static structure and a dynamic structure comprising:

a first trunnion assembly comprising a vertical trunnion which allows said first trunnion assembly to rotate around a vertical axis while restricting its movement in all other directions, said vertical trunnion comprising a static support shell rigidly attached to a static structure, and a vertical shaft adjacent to said static support shell, wherein said vertical shaft can rotate about a longitudinal axis of said static support shell and relative to said static support shell;

a horizontal member attached to said vertical shaft such that said horizontal member rotates with said vertical shaft, said horizontal member comprising a horizontal trunnion rigidly attached at each of its ends;

a connecting bridge pivotally connected at one end to said horizontal trunnions of said first trunnion assembly such that said connecting bridge can rotate around both a vertical and horizontal axis relative to said static structure, the connecting bridge also being pivotally connected at its opposite end to a second trunnion assembly such that said second trunnion assembly allows rotation around both the roll and pitch axes relative to said connecting bridge; and a second trunnion assembly comprising a first support frame and a second support frame, said second support frame having upper and lower sections, said second trunnion assembly further comprising:

a roll trunnion, connecting said first and second support frames such that said second support frame is allowed to rotate around a roll axis relative to said first support frame;

a pitch trunnion affixed to the first support frame, said pitch trunnion being pivotally affixed to the connecting bridge such that said second trunnion assembly can rotate around the pitch axis relative to the connecting bridge; and an isolator means for absorbing forces through a bottom surface of said second trunnion assembly.

48. The coupling device of claim 47 wherein said isolator means comprises a plurality of springs.

49. A trunnion assembly comprising a first support frame and a second support frame, said trunnion assembly further comprising:

a roll trunnion having a mounting rod running transversely through said first support frame and being attached to the first support frame, said mounting rod also passing through an upper section of the second support frame such that the second support frame is supported by the mounting rod and the second support frame is allowed to rotate more than 16° around the longitudinal axis of said mounting rod relative to said first support frame;

a pitch trunnion affixed to the first support frame, said pitch trunnion being pivotally affixed to a connecting bridge such that said second trunnion assembly can rotate around a pitch axis relative to the connecting bridge; and an isolator means for absorbing forces through a bottom surface of said second trunnion assembly.

50. The coupling device of claim 49 wherein said isolator means comprises a plurality of springs.

* * * * *

UNITED STATES PATENT AND TRADEMARK OFFICE

CERTIFICATE OF CORRECTION

PATENT NO. : 6,131,224
DATED : October 17, 2000
INVENTOR(S) : Alvaro Bernal

It is certified that error appears in the above-identified patent and that said Letters Patent is hereby corrected as shown below:

Column 7,
Line 7, delete "is 5"

Column 10,
Line 19, delete "is 5"

Column 11,
Line 1, delete "1 18" and insert -- 118 --

Column 15,
Line 54, delete "firs t" and insert -- first --

Signed and Sealed this

Fifth Day of March, 2002

*Attest:*

*Attesting Officer*

JAMES E. ROGAN
*Director of the United States Patent and Trademark Office*